US007438206B2

(12) United States Patent
Kumayama

(10) Patent No.: US 7,438,206 B2
(45) Date of Patent: Oct. 21, 2008

(54) STAPLER AND CONNECTED STAPLE ASSEMBLY CASSETTE

(76) Inventor: Michihito Kumayama, c/o SEBEK LIMITED 1-30-5, Hamamatsu-cho, Minato-ku, Tokyo 105-0013 (JP)

( * ) Notice: Subject to any disclaimer, the term of this patent is extended or adjusted under 35 U.S.C. 154(b) by 36 days.

(21) Appl. No.: 10/564,979

(22) PCT Filed: Jul. 18, 2003

(86) PCT No.: PCT/JP03/09134

§ 371 (c)(1),
(2), (4) Date: Jan. 18, 2006

(87) PCT Pub. No.: WO2005/007349

PCT Pub. Date: Jan. 27, 2005

(65) Prior Publication Data

US 2006/0231583 A1 Oct. 19, 2006

(51) Int. Cl.
*B25C 5/11* (2006.01)
*B25C 5/00* (2006.01)

(52) U.S. Cl. ..... 227/127; 227/120

(58) Field of Classification Search ..... 227/120, 227/134, 119, 109

See application file for complete search history.

(56) References Cited

U.S. PATENT DOCUMENTS

| | | | | | |
|---|---|---|---|---|---|
| 1,962,874 | A * | 6/1934 | Polzer | 227/123 |
| 2,501,564 | A * | 3/1950 | Goodstein | 227/134 |
| 2,632,889 | A * | 3/1953 | Beecroft | 227/120 |
| 4,597,517 | A | 7/1986 | Wagdy | 227/8 |
| 4,763,824 | A * | 8/1988 | Ebihara | 227/120 |
| 4,784,307 | A * | 11/1988 | Ebihara | 227/120 |
| 5,758,813 | A * | 6/1998 | Kikuchi et al. | 227/155 |
| 6,942,136 | B2 * | 9/2005 | Tsai | 227/155 |
| 2003/0155399 | A1 * | 8/2003 | Jairam et al. | 227/127 |
| 2003/0155400 | A1 * | 8/2003 | Jairam et al. | 227/134 |

FOREIGN PATENT DOCUMENTS

| | | |
|---|---|---|
| JP | 61-112871 | 7/1986 |
| JP | 6-42075 | 6/1994 |
| JP | 9-47978 | 2/1997 |
| JP | 9-70767 | 3/1997 |
| JP | 2002-507492 | 3/2002 |
| JP | 2002-337065 | 11/2002 |

* cited by examiner

*Primary Examiner*—Rinaldi I. Rada
*Assistant Examiner*—Lindsay Low
(74) *Attorney, Agent, or Firm*—Staas & Halsey LLP

(57) ABSTRACT

There is provided a stapler which can perform a stapling operation with smaller force. A connected staple assembly cassette eliminates a metallic feed spring pressing the connected staple assembly, and instead, a reverse movement stop feeder is mounted. A mount sensor for sensing the mounting of the connected staple assembly cassette is provided for the stapler. In addition, a pusher piece is provided in order to follow up the reverse movement stop feeder in the connected staple assembly cassette with the sensing of the mount sensor and to push forward the reverse movement feeder. A magazine support spring for returning the staple mount magazine to the original position is eliminated, and the staple mount magazine can be returned to the original position by the released operation handle. During the advancing of the front staple in the staple lowering slit, the next staple can be blocked from advance movement.

4 Claims, 17 Drawing Sheets

STAPLER AND CONNECTED STAPLE ASSEMBLY CASSETTE

FIELD OF THE INVENTION

The present invention relates to a stapler for stapling a plurality of papers or the like with a staple bent approximately in the form of U-shape and relates to a connected staple assembly cassette used for the stapler.

BACKGROUND TECHNOLOGY

In a conventional art, there is known a stapler which is used for stapling a plurality of papers or the like with a U-shaped staple as office equipments or goods which is widely usefully used.

Prior art has provided a number of staplers having various structures, one of which is shown in FIG. 17 as sectional view (refer to Japanese Patent Laid-open (KOKAI) Publication No. 2002-337065).

Referring to FIG. 17, the stapler includes a horizontal base 1 provided with an anvil 2 for guiding a bending movement of a lower end of a staple, a pivot shaft or pin 3 for a mount portion provided for the horizontal base 1, a staple mount magazine 4 supported by the pivot shaft 3, a pivot shaft or pin 5 for a handle provided for the staple mount magazine 4, a push-down or depressing handle 6 supported by the handle pivot shaft 5. A magazine support spring 7 is disposed between the horizontal base 1 and the staple mount magazine 4, and a handle support spring 8 is also disposed between the staple mount magazine 4 and the push-down handle 6. The staple mount magazine 4 has a structure to which a connected staple assembly cassette 20, into which a number of staples are connected as staple assembly 21, are mounted.

A blade path 9 is formed to one end portion of the staple mount magazine 4, and a staple striking blade plate 10 capable of moving downward in the blade path 9 is connected to the push-down handle 6.

FIG. 18 is a schematic view of a conventional connected staple assembly cassette 20 to be mounted to the staple mount magazine 4. The connected staple assembly cassette 20 has an elongated case 12, in which a connected staple assembly 21 having a number of connected staples is mounted with one end thereof on one longitudinal end side in the case 12, and has a metallic feed spring 13 in the case 12 as a stapler feeding means for urging and sequentially feeding the staples of staple assembly 21 toward the one longitudinal end side or a front end side of the case 12. At a bottom portion of the one longitudinal end side is provided a slit 14 through which the staple is pushed down.

When the connected staple assembly cassette 20 is mounted to the staple mount magazine 4, it is mounted so that the front one staple of the connected staple assembly 21 displaced to one longitudinal end side portion can be easily struck by the staple striking blade plate 10.

Then, when such conventional stapler is used, the connected staple assembly cassette 20 is first mounted to the staple mount magazine 4, and plural sheets of papers are placed on the anvil 2 so as to cover the anvil 2. In this state, the push-down handle 6 is depressed. The push-down handle 6 and the staple mount magazine 4 are lowered together around the pivot shaft 3 against a repulsion force of the magazine support spring 7. At a time when one end side bottom portion of the connected staple assembly cassette 20 reaches above the stacked papers on the anvil 2, the staple mount magazine 4 once stops in its lowering operation. However, the push-down handle 6 is further pushed downward, the push-down handle 6 is pivoted around the handle pivot shaft 5 against the repulsion force of the magazine support spring 7 and a repulsion force of the handle support spring 8. Next, the staple striking blade plate 10 suspending from the push-down handle 6 is lowered along the blade path 9, and then, strikes the front one staple of the connected staple assembly in the staple assembly cassette 20 into the stacked papers.

Most of conventional staplers has substantially the identical structure to that mentioned above, which thus provides a common problem for use.

As mentioned above, the conventional stapler is provided with the horizontal base 1, the pivot shaft 3 for the mount portion, the staple mount magazine 4, the handle pivot shaft 5, the push-down handle 6 and so on. The push-down handle 6 is coupled to the staple mount magazine 4 by way of the handle pivot shaft 5. Moreover, the conventional stapler requires two springs such as magazine support spring 7 and handle support spring 8. The magazine support spring 7 acts to return the depressed staple mount magazine 4 to the original position after the staple mount magazine 4 has been pushed down, and on the other hand, the handle support spring 8 acts to return the depressed push-down handle 6 to the original position after the push-down handle 6 has been pushed down. The magazine support spring 7 and the handle support spring 8 are related independently to the mount portion pivot shaft 3 and the handle pivot shaft 5. The push-down handle 6 is depressed against the repulsion force of the magazine support spring 7 till the staple assembly cassette 20 reaches the stacked papers. After the reaching, the push-down handle 6 is further depressed against the repulsion forces of the handle support spring 8 and the magazine support spring 7. Because of this reason, the staple striking work creates a problem of requiring much more force in the second half striking stage, providing a problem.

The connected staple assembly 21 is pushed by the feed spring 13 in a time when the staple striking blade plate 10 pushes down the front side one staple in the connected staple assembly cassette 20. When the depressing force on the push-down handle is loosened during the staple depressing process and the staple striking blade plate 10 once moves upward, the next staple in the connected staple assembly is pushed by the feed spring 13, and under the state of the front one staple remaining, the next staple is pushed into the slit 14 through which a staple is pushed down, thus both staples being entangled in the slit. In such state, when the handle 6 is further depressed, the staple striking blade plate 10 will depress a plurality of staples at once. As a result, there will cause a trouble in the staple striking process, thus also providing a problem.

Some conventional staplers use no case 12, in which a number of staples are connected by bonding agent and the thus connected staple assembly 21 is directly mounted in the staple mount magazine 4. In such conventional staplers having no case 12, the connected staple assembly 21 will be easily disassembled, and it is difficult for the disassembled staples to be set in the staple mount magazine 4 as they are, and many staples becomes useless. In order to obviate such defect, there is often used the connected staple assembly cassette 20 in which the connected staple assembly 21 is mounted in the case 12.

Usually, the case 12 of the connected staple assembly cassette 20 is disposable. The case 12 is made of synthetic resin, and a metallic feed spring 13 is installed inside the case 12. Accordingly, when the case is disposed of, the feed spring 13 is together disposed of. Such structure is complicated and expensive as a disposable product, and accordingly, the disposal is not reasonable nor economical. This disposable product includes the synthetic resin member and the metal member, so that an environmental load is to also be considered.

DISCLOSURE OF THE INVENTION

Then, a principle object of the present invention is to provide a more easily usable stapler and a connected staple assembly cassette.

More specifically, a first object of the present invention is to provide a stapler operable with smaller operation force.

A second object is to provide a stapler which is capable of being easily obtained at low cost and using a connected staple assembly cassette having a gentle environmental load as waste disposal. A third object is to provide a stapler having less striking trouble. A fourth object is to provide a connected staple assembly cassette which is capable of being easily obtained at low cost as non-returnable member and using a connected staple assembly cassette having a gentle environmental load as waste disposal.

In order to achieve the first object, the present invention takes the following means.

The first invention provides a stapler including a horizontal base, an operation handle, a staple striking blade plate, and a staple mount magazine to which a connected staple assembly composed of a number of connected staples or a connected staple assembly cassette is mounted, the horizontal base, the operation handle and the staple mount magazine being coupled by means of a pivot shaft member.

The pivot shaft member includes an operation shaft member and a mount shaft portion, in which the operation shaft member connects the horizontal base and the operation handle elastically to be rotatable, and the mount shaft member connects the horizontal base and the staple mount magazine.

The staple mount magazine has a magazine upper dead center so as to be rotatable in a range below the magazine upper dead center through the mount shaft portion and is provided with a staple striking blade plate vertical slit having slit upper and lower dead centers.

The staple striking blade plate has an upper portion connected to the operation handle and is disposed between the operation handle and the horizontal base. The staple striking blade plate is vertically movable in the staple striking blade plate vertical slit in association with an operation of the operation handle, and when the operation handle is elastically pushed downward, the lower end of the staple striking blade plate lowers in the staple striking blade plate vertical slit of the staple mount magazine, and the staple striking blade plate has a vertical dimension reaching the horizontal base surface.

When the operation handle is depressed downward, the staple striking blade plate lowers in the staple striking blade plate vertical slit. In a case that the connected staple assembly cassette is mounted to the staple mount magazine, one staple at the front end side, i.e., one end side, of the connected staple assembly is pushed downward by the staple striking blade plate. When the lower end of the staple assembly magazine or the connected staple assembly cassette contacts paper or the like, the lowering movement of the staple assembly magazine stops. When the operation handle is further lowered, bonded force between the mutually adjacent staples is weaken by the lowering force, and only the depressed one staple is separated from the connected staple assembly and further lowered. Thus, the staple invades inside the paper or the like.

When the depressing force of the operation handle is released, the operation handle rises elastically upward. In association with this upward movement, the staple striking blade plate is also raised to thereby pull up the staple mount magazine. The upward movement continues until the staple mount magazine reaches the upper dead center of the staple mount magazine. The rising movement of the staple striking blade plate stops at the slit upper dead center. When reaching there, the upward movement of the staple mount magazine stops and the upward movement of the staple striking blade plate also stops. Accordingly, the upward movement of the operation handle also stops.

When the operation handle is depressed, the reaction force applied to the operation handle is in fact a combination of elastic force generated by the elastic body in the handle pivot shaft member and bonding and friction force between the adjacent staples. There is no need of the existence of the magazine support spring. Accordingly, the operation handle can be depressed by a small force corresponding to the spring force.

The second invention is, in addition to the first invention, characterized in that the horizontal base includes shaft support means standing so as to extend above the staple mount magazine, the operation shaft member is disposed above the staple mount magazine in engagement with the shaft support means, and the operation handle is connected to the operation shaft member in engagement with the shaft support means.

According to this invention, since the shaft support means stands so as to extend above the staple mount magazine, and the handle pivot shaft member is disposed above the staple mount magazine, so that the staple mount magazine can be formed to have a relatively long length and the staple assembly cassette in which a lot of staples are connected can be mounted.

In order to achieve the second object, the present invention takes the following means.

The third invention provides a stapler including a horizontal base, an operation handle, a staple striking blade plate, and a staple mount magazine with which is mounted a connected staple assembly cassette having a case body and a connected staple assembly composed of a number of staples disposed in the case body, the horizontal base, the operation handle and the staple mount magazine being coupled by means of pivot shaft member.

The staple striking blade plate has an upper portion connected to the operation handle and is disposed between the operation handle and the horizontal base, the staple striking blade plate being vertically movable in association with an operation of the operation handle, and the staple striking blade plate has a vertical width such that when the operation handle is pushed down in a direction of the horizontal base, a lower end thereof reaches the horizontal base surface.

The staple mount magazine has a mount case, a feed mechanism and a staple lowering slit, the mount case serving to vertically hold the connected staple assembly of a number of staples each having substantially U-shape having a right angled corner, having a structure in which both lower end of the bent staple is directed to the horizontal base, and having one end side and another end side so as to be mounted in a range from a front end to a rear end of the staple.

The one end side is mounted to the rear end side of the connected staple assembly, and the other end side is mounted to the front end portion of the connected staple assembly and provided with the staple lowering slit as a blade plate passage.

The staple lowering slit is formed with an opening so as to guide, in the lowering direction, the staple which is separated from the front end of the connected staple assembly and lowered in the slit.

The feed mechanism includes a mount sensor, a pusher piece, a pusher piece engaging member, and a pusher piece traction spring, the mount sensor having a structure being displaced and deformed by sensing presence or absence of the connected staple assembly.

The pusher piece engaging member engages the pusher piece and releases the engagement under the condition of the displacement and deformation of the mount sensor.

The pusher traction spring elastically pulls the pusher piece in the other end side in the staple mount magazine.

The pusher piece moves from the one end side toward the other end side in the staple mount magazine as an advance passage, the pusher piece is subjected to elastic traction force in the other end side direction by the pusher piece traction spring and advances in the advance passage when the engagement is released, and the rear end of the connected staple assembly is formed to be elastically pressed in the other end direction of the mount case.

With respect to the third invention, it is the basic principle to mount the staple to a connected staple assembly cassette, or to mount the connected staple assembly composed only of a number of connected staples with no use of a case body.

When the connected staple assembly cassette is mounted, the feed mechanism senses the mounting and the pusher piece elastically feeds the rear end of the connected staple assembly toward the front end side. Even for the connected staple assembly cassette with the case body, this invention can be effectively adapted to the connected staple assembly cassette at low cost and with small environmental load as waste disposal. Furthermore, it can be easily adapted to the connected staple assembly with no case body.

The fourth invention is, in addition to the structure of the third invention, characterized in that the feed mechanism is provided with a rear end sensing sensor sensing the passing of the rear end of the connected staple assembly at the rear end of the mount magazine at a time of mounting the staple assembly cassette and being displaced and deformed by sensing the passing, and the pusher piece engaging member is provided with releasing means for releasing the engagement with the pusher piece under the condition of the displacement and deformation of the rear end sensing sensor.

According to this invention, the pusher piece engaging member releases the engagement between the rear end of the connected staple assembly and the pusher piece by confirming the passing of the rear end of the staple mount magazine. The pusher piece is not released from its engagement as far as confirming the mounting of the connected staple assembly cassette and the passing of the rear end of the staple mount magazine, erroneous operation can be further effectively prevented from causing.

The fifth invention is, in addition to the structure of the fourth invention, is characterized in that the rear end sensing sensor commonly serves as the mount sensor.

In order to achieve the third object, the present invention adopts the following means.

The sixth invention provides a stapler including a horizontal base, an operation handle, a staple striking blade plate, and a staple mount magazine with which is mounted a connected staple assembly cassette having a case body and a connected staple assembly composed of a number of staples disposed in the case body, the horizontal base, the operation handle and the staple mount magazine being coupled by means of pivot shaft member.

The staple mount magazine is provided with a staple mount case, a staple feed mechanism and a staple lowering slit, the staple mount case has a structure in which the connected staple assembly cassette, in which a number of connected staples each having a U-shape bent in a right angle at a corner portion are accommodated, is mounted, the staples are held in the vertical direction and both the lower ends of the staple are directed toward the horizontal base.

The staple feed mechanism has a mechanism successively elastically feeding the staple positioned on the front end side of the connected staple assembly in the connected staple assembly cassette into the staple lowering slit path along which the staple striking blade plate is vertically moved.

The staple lowering slit path is opened to the staple striking blade plate moving path so as to guide downward the staple which is separated and lowered from the front end of the connected staple assembly.

The staple striking blade plate is connected at an upper end thereof to the operation handle to be rotatable and disposed between the operation handle and the horizontal base in a suspended state to be vertically movable in association with the movement of the operation handle, and when the operation handle is depressed toward the horizontal base, the operation handle has a vertical dimension such that when the operation handle is lowered, the lower end thereof reaches the horizontal base surface, the operation handle having large and small thickness portions.

The other surface side of the staple striking blade plate forms a perpendicular plane to the lower end thereof, and one surface side forms an inclination surface inclining at the lower end portion of at least the large thickness portion and contacts the connected staple assembly in the staple lowering slit.

The inclination surface formed on one surface side contacts, in the staple lowering slit, the second staple adjacent to the first staple positioned at the front end of the connected staple assembly in the connected staple assembly cassette to be mounted to the staple mount magazine, the staple after the first staple (one following first one staple) advances or retires in the staple lowering slit with a limit corresponding to the thickness of the plate of the staple striking blade plate.

A staple sensor and an advance movement block mechanism are provided parallelly to the staple lowering slit, and the staple sensor has a mechanism which is displaced and deformed with presence or absence of the first staple separated from the front end of the connected staple assembly in the staple lowering slit.

The advance movement block mechanism is provided with a movable member which shields the advancing path of the second staple during the presence of the first staple in the staple lowering slit in accordance with the displacement and deformation of the staple sensor, projects between the small thickness portions of the staple striking blade plate, and blocks the advance movement of the connected staple assembly after the second staple.

The seventh invention provides a stapler including a horizontal base, an operation handle, a staple striking blade plate, and a staple mount magazine with which is mounted a connected staple assembly cassette having a case body and a connected staple assembly composed of a number of staples disposed in the case body, the horizontal base, the operation handle and the staple mount magazine being coupled by means of pivot shaft member.

The staple mount magazine is provided with a staple mount case and a staple lowering slit, the staple mount case having a structure in which the connected staple assembly cassette is mounted, and the connected staple assembly being accommodated in the case body of the connected staple assembly cassette.

The connected staple assembly cassette is provided with a structure having feed means for successively elastically feeding the connected staple assembly in the front end direction thereof and successively feeding the staple positioned on the front end side of the connected staple assembly in the connected staple assembly cassette into the staple lowering slit along which the staple striking blade plate is moved.

The staple lowering slit is opened to the lower end of the staple striking blade plate so as to guide downward the staple which is separated and lowered from the front end of the connected staple assembly.

The staple striking blade plate is connected at an upper end thereof to the operation handle to be rotatable and disposed between the operation handle and the horizontal base in a suspended state to be vertically movable in association with the movement of the operation handle, and when the operation handle is depressed toward the horizontal base, the operation handle has a vertical width such that when the operation handle is lowered, the lower end thereof reaches the horizontal base surface, the operation handle having large and small thickness portions.

The other surface side of the staple striking blade plate forms a perpendicular plane to the lower end thereof, and one surface side forms an inclination surface inclining at the lower end portion of at least the large thickness portion and contacts the connected staple assembly in the staple lowering slit.

The inclination surface formed on one surface side contacts, in the staple lowering slit, the second staple adjacent to the first staple positioned at the front end of the connected staple assembly in the connected staple assembly cassette to be mounted to the staple mount magazine, the staple after the second one advances, stops or retires in the staple lowering slit with a limit corresponding to the thickness of the plate of the staple striking blade plate.

A staple sensor and an advance movement block mechanism are provided in parallel to the staple lowering slit, and the staple sensor has a mechanism which is displaced and deformed in accordance with presence or absence of the first staple separated from the front end of the connected staple assembly in the staple lowering slit.

The advance movement block mechanism is provided with a movable member which shields the advance path of the second staple during the presence of the first staple in the staple lowering slit in accordance with the displacement and deformation of the staple sensor, projects between the small thickness portions of the staple striking blade plate, and blocks the advance movement of the connected staple assembly after the second staple.

The sixth invention has a basic principle of being mounted with a connected staple assembly cassette of the ninth invention or tenth invention. The seventh invention has a principle of being mounted with a conventional connected staple assembly cassette. The essential structures of the sixth invention and the seventh invention are substantially common to each other.

In the sixth and seventh inventions, when the staple striking blade plate pushes down the operation handle, it lowers in the staple lowering slit and pushes downward the first staple positioned at the front end portion of the staple assembly. When the first staple invades into the slit, the inclination surface of the staple striking blade plate vertical end portion contacts, on the staple lowering slit, the second staple in the connected staple assembly, retires the second staple in the rear end direction, or stops the advancing thereof. Simultaneously, the invasion of the first staple into the staple lowering slit can be sensed by the staple sensor. The movable portion of the advance movement block mechanism projects and the movable member shields the advance passage of the second staple. Even if the staple striking blade plate be come off, the second staple never advance as far as the first staple exists in the staple lowering slit. When the staple striking blade plate is come off and the first staple is came off from the slit, this is sensed by the staple sensor and the advance movement blocking mechanism release the projecting motion.

According to this structure, there is less caused any staple striking trouble such as tangle of the staples.

The eighth invention is, in addition to the structure of the sixth invention or seventh invention, characterized in that the staple lowering slit has an opening surrounded by a perpendicular stationary wall section and a plate spring wall sensor as the staple sensor.

The plate spring wall sensor has a lower end elastically contacting a lower portion of the perpendicular stationary wall section. A lower portion of the plate spring wall sensor serves to open the staple lowering slit while describing an arc at a distance corresponding to at least a thickness of the staple. The advance movement blocking mechanism is provided with a vertically movable member which is provided to a back surface of the plate spring wall sensor and follows up rotation of the plate spring wall sensor. It has a lower end which is separated from the perpendicular stationary wall section upon the rotation of the plate spring wall sensor. The advance movement blocking mechanism opens the staple lowering slit and rises upward at the rear surface of the plate spring wall sensor in accordance with the opening movement of the staple lowering slit. The vertically movable member is provided with a movable member as a vertically movable projection which projects at a corner portion at which the inclination surface of the lower end portion of the staple striking blade plate contacts the second staple, and blocks the advance movement of the connected staple assembly after the second staple in the advance passage of the second staple.

According to this invention, the plate spring wall sensor is rotated and the staple is sensed by its plate surface. The projection piece projects in the advance passage of the second staple.

In order to achieve the fourth object, the present invention adopts the following means.

The ninth invention provides connected staple assembly cassette, wherein two horizontal plate wall bodies are vertically provided, each of which has a length longer than a length between a front end of a connected staple assembly formed by connecting a number of staples each having substantially U-shape with an corner portion bent at a right angle and rear end thereof with a width of clamping both leg portions of the staple.

A case body is formed so as to be surrounded in three directions by a both wall sections of the horizontal plate wall bodies and a top plate disposed on upper ends of both the wall sections so as to have a length more than a length between the front end of the connected staple assembly and the rear end thereof.

A number of reverse movement block irregular portion are formed in form of connected beads to a front end of a wall section or top plate to a rear end thereof at an inner periphery of the case body, and the connected staple assembly is mounted to a front end side of the inner periphery of the case body.

A stop edge projecting on the inner periphery side of the case body is provided for at least either one of the wall section or top plate at the front end of the case body.

The staple striking blade plate abutting against a first staple of the front end of at least the connected staple assembly opens an exposed portion without covering the upper portion of the first staple with the top plate by an amount corresponding to a thickness thereof.

A reverse movement stop feeder for blocking a reverse movement of the connected staple assembly is mounted in the case body at the rear end of the connected staple assembly.

The reverse movement stop feeder is provided with a pawl projection for stopping the reverse movement, the pawl projection has an elastic portion slidable in the advancing direction and preventing the advancing movement in the reverse direction, the elastic portion is elastically engaged with the reverse movement blocking irregular portion, and the pawl projection advances from the rear end side to the front end side in the base body in accordance with reduction of the staples of the connected staple assembly.

The connected staple assembly cassette can be basically formed only of a cheap synthetic resin and there is no need of metallic spring member. Because of no presence of combination of different materials or members, no separate disposal is not required at waste disposal treatment, thus being less in environmental load and being easily recycled.

The tenth invention is, in addition to the structure of the ninth invention, is characterized in that the reverse movement stop feeder serves to connect, by an elastic coupling portion, a proceeding piece and a following piece following the proceeding piece, and the reverse movement blocking pawl projection is provided for the following piece.

The proceeding piece and following piece are elastically connected and the pawl projection for the reverse movement blocking is provided for the following piece, so that the connected staple assembly can be surely retired in the elastic range of the proceeding piece.

BEST MODE FOR EMBODYING THE INVENTION

Structures of a stapler and a connected staple assembly cassette according to the present invention will be first described hereunder with reference to embodiments of the accompanying drawings.

(1) Horizontal Base 31

Figure 1:
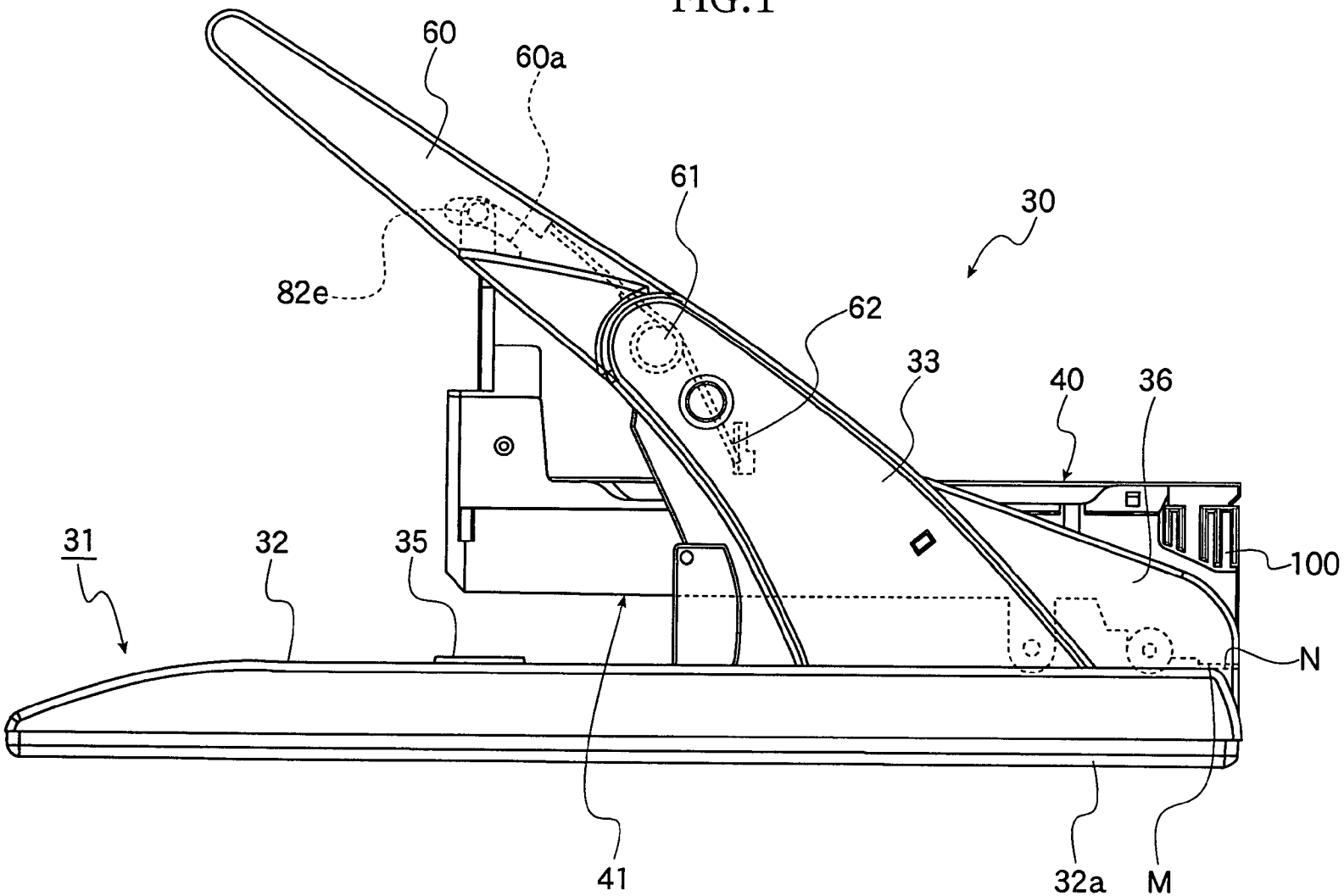
FIG. 1 is a front view of a stapler according to an embodiment of the present invention.
Figure 2:
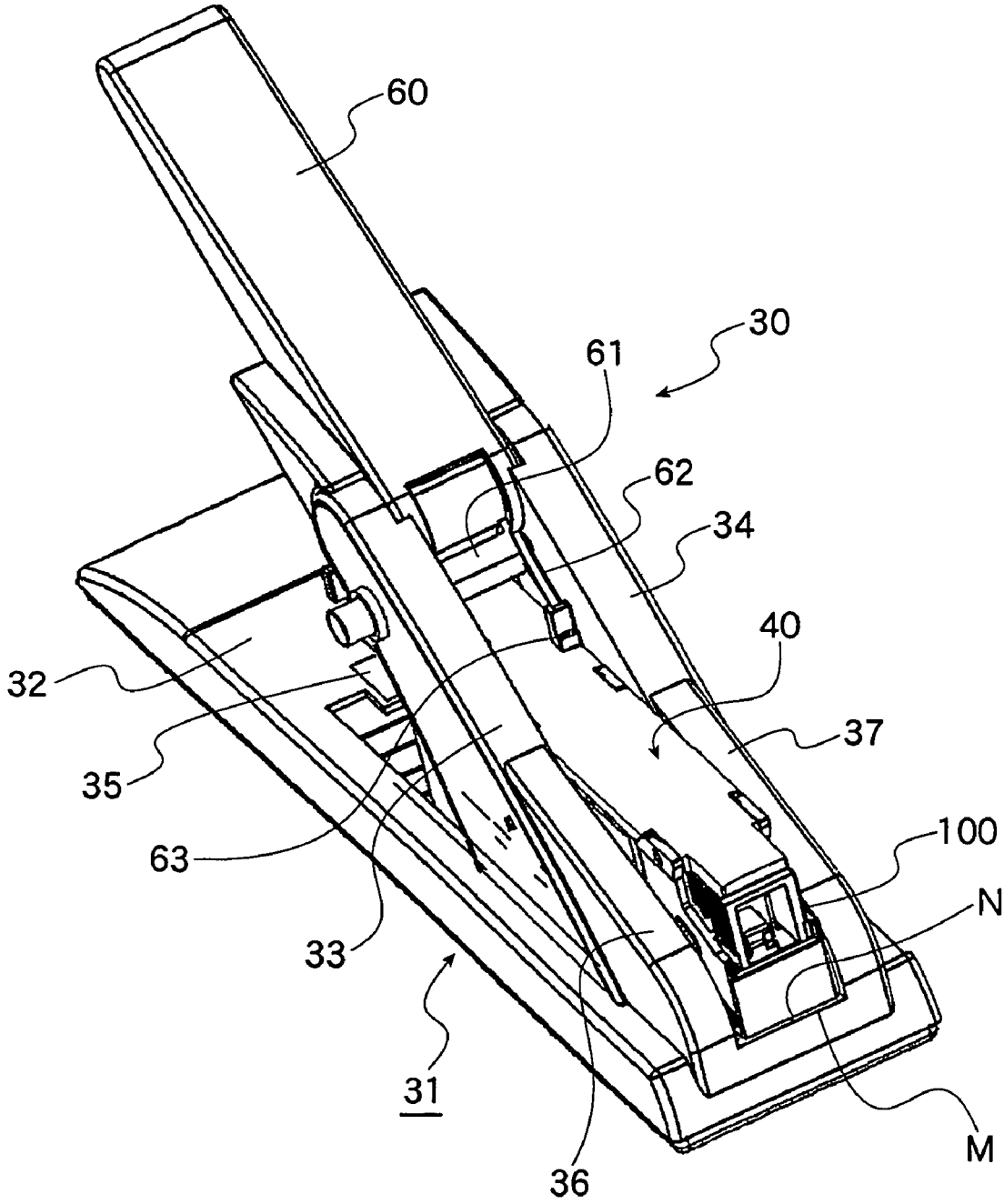
FIG. 2 is a perspective view showing an outer configuration of the stapler of FIG. 1
Figure 3:
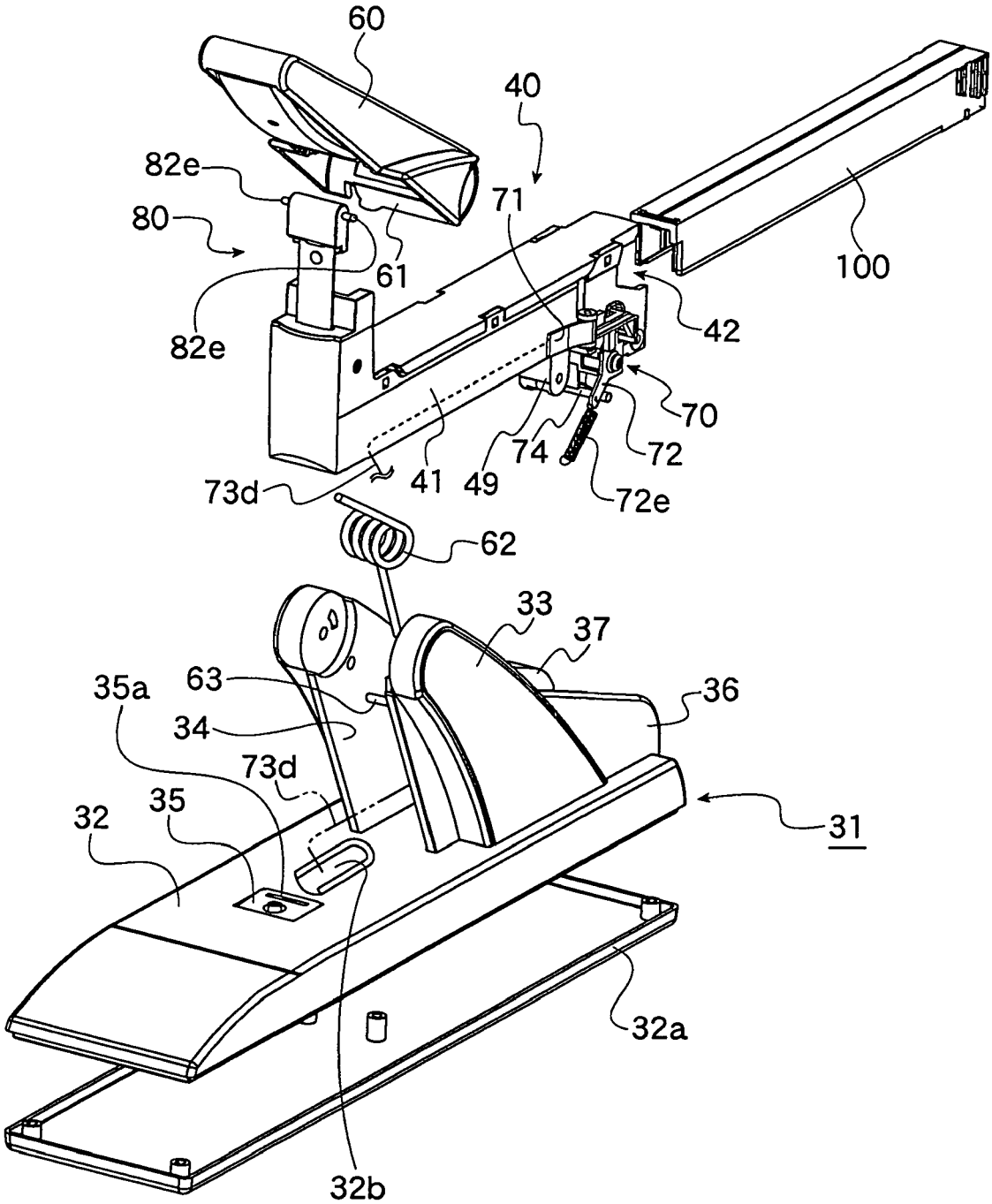
FIG. 3 is a developed perspective view showing an outer configuration of the stapler of FIG. 1.

FIG. 1 is a front view of a stapler according to an embodiment of the present invention, FIG. 2 is a perspective view showing an outer configuration thereof and FIG. 3 is a developed perspective view of the stapler.

The stapler is provided with a horizontal base 31, a staple mount magazine 40 mounted with a connected staple assembly cassette 100 in which a number of staples are accommodated, and an operation handle 60 for pushing the staple into a stack of paper or the like.

The horizontal base 31 has a relatively narrow width in the width direction and has a horizontal flat portion 32 as a body extending from one end to the other end of the horizontal base 31. The horizontal base 31 is also provided with a pair of stand pieces 33 and 34 for the handle, which stand at both sides in the width direction of the longitudinal central portions of the horizontal base 31, the paired stand pieces 33 and 34 constituting shaft support member with which a pivot shaft of the operation handle 60 is engaged. The horizontal flat portion 32 is formed, at a lower surface thereof, with a base pad 32*a*, and an anvil 35 is also provided at the central portion of the horizontal flat portion 32. A staple receive groove 35*a* for bending a lowering staple into a predetermined bent shape is formed in a slit shape in the width direction.

(2) Operation Handle 60

A handle pivot shaft 61 formed near one end side of the operation handle 60 is fixed to an upper portions of the handle stand pieces 33 and 34 as the shaft support member. The manually movable elongated operation handle 60 is coupled to the handle pivot shaft 61 to be rotatable. A push-down twist coil spring 62 is mounted to the handle pivot shaft 61. The push-down twist coil spring 62 has one end engaged with a portion of the handle stand piece 33 or 34 as an enlarged portion of the horizontal base 31 and another one end engaged with a rear surface of the operation handle 60. According to such structure, the elongated operation handle 60 is lifted up at its other end side and is elastically mounted to be rotatable to the handle stand pieces 33 and 34 through the handle pivot shaft 61, and the other one end side is disposed relatively downward. A stopper 63 with which one end of the push-down twist coil spring 62 is engaged is formed inside one of the handle stand pieces 33 so as to project.

On the horizontal flat portion 32, a first and second stationary wall sections 36 and 37 having substantially the same distance as that between the stand pieces 33 and 34 are disposed so as to stand upward. The first and second stationary wall sections 36 and 37 has their starting points at one end front portion of the horizontal flat portion 32 and their ending points at the lower portions of the handle stand pieces 33 and 34.

(3) Staple Mount Magazine 40

The connected staple mount magazine 40 is provided for the horizontal base 31. The connected staple mount magazine 40 has a mount case body 41, a cassette insertion port 42, a feed mechanism 70 and a staple striking mechanism 80. The cassette insertion port 42 constitutes an inlet through which the staple assembly cassette 100 is inserted. The feed mechanism 70 acts to feed the connected staples in the inserted staple assembly cassette 100 toward the other side end thereof. The staple striking mechanism 80 acts to strike the staple fed to the other end side.

Figure 4:
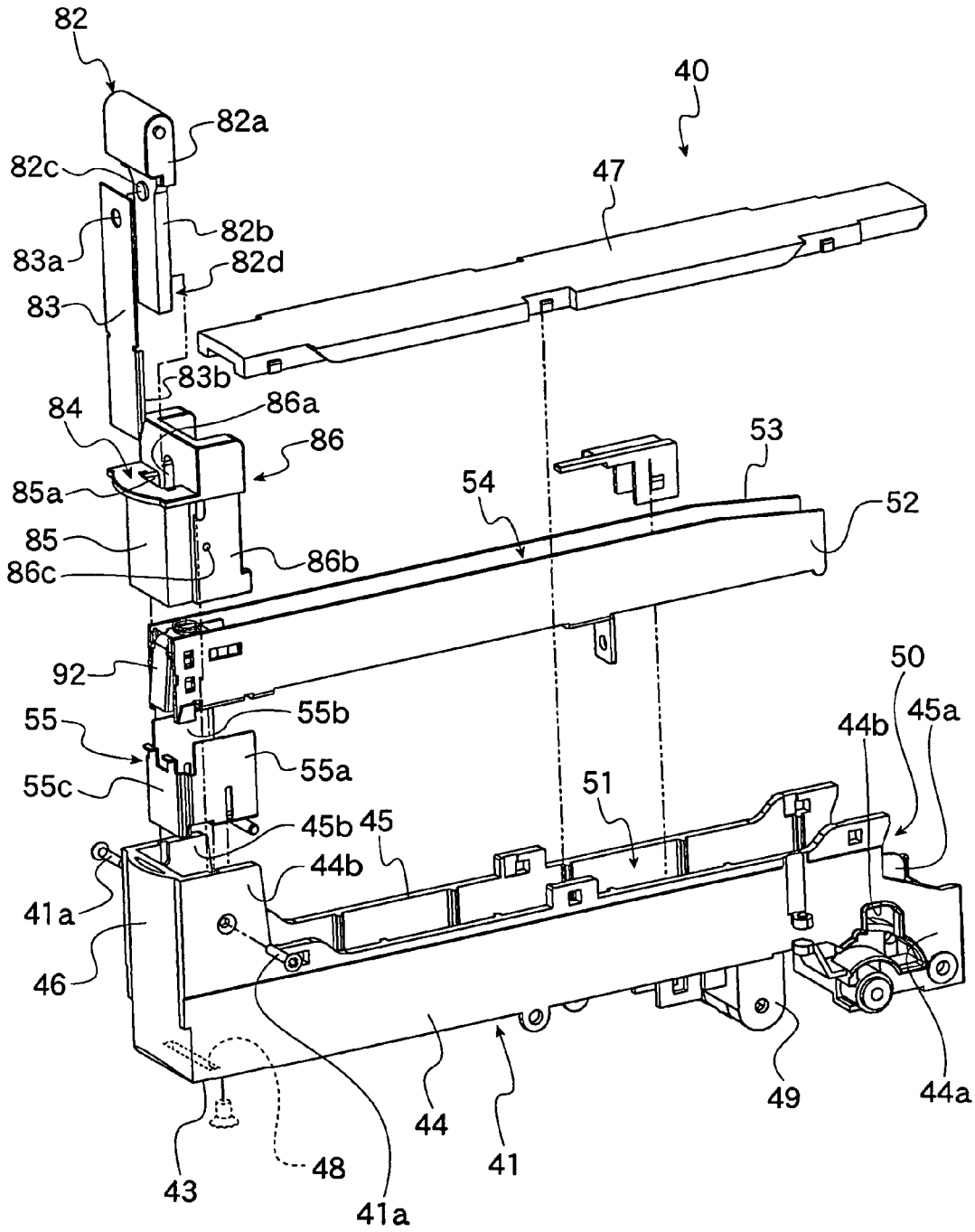
FIG. 4 is a developed perspective view of a staple mount magazine.

FIG. 4 is a developed perspective view of the staple mount magazine 40. The mount case body 41 is formed from an elongated horizontal bottom plate 43, a first side wall section 44 and a second side wall section 45, a third side wall section 46 on the other end side and a top plate 47 covering the upper side.

The first side wall section 44 and the second side wall section 44 stand on both width sides of the horizontal bottom plate 43 respectively, so as to oppose to each other. Both the first and second side wall sections 44 and 45 and the horizontal bottom plate 43 constitute three side portions, and the top plate 47 is applied to be detachable on the top portion surrounded by these three sections. Accordingly, the thus formed mount case body 41 has a rectangular cylindrical structure having substantially a square vertical section. The horizontal bottom plate 43 is formed with a staple lowering slit 48, extending in the width direction thereof, through which the staple is lowered as shown with dotted line in FIG. 4. A mount portion pivot shaft member 49 is disposed to the lower surface of the horizontal bottom plate 43 at its one end side so as to extend downward. A rotation shaft, not shown, penetrates the mount portion pivot shaft member 49, and the rotation shaft is coupled, to be rotatable, with the first stationary wall section 36 and the second stationary wall section 37 of the horizontal base 31. Furthermore, the staple mount magazine 40 is formed to be rotatable in a range below an upper dead center of the magazine, the magazine dead center being a position in which a lower end surface M on one end side of the staple mount magazine 40 contacts an upper end surface N of a central opening on one end side of the horizontal base 31.

An opening is formed on the upper portion of the other end side of the mount case body 41 at which the top plate 47 is not formed, this opening being formed as a staple striking opening.

One end side of the mount case body 41 is partly closed by a wall plate so as to form an opening for the cassette insertion port 50 is opened. The horizontal bottom plate 43 extends in its longitudinal direction and has a longitudinal length shorter than the first and second side wall sections 44 and 45, thereby forming an opening at its one end side. This opening acts as a mount port for the feed mechanism 70.

A feeder mount path 51 is formed inside the mount case body 41 for mounting the connected staple assembly cassette 100 through the cassette insertion port 50. The feeder mount path 51 is formed between the first and second side wall sections 44 and 45 mentioned before. Inside the first and second side wall sections 44 and 45, a first and second inside wall sections 52 and 53 having low height are disposed to be parallel with each other as well as with the first and second side wall sections 44 and 45. The first inside wall section 52 and the second inside wall section 53 are disposed so as to stand from one end side toward the other end side so as to define a pusher piece advancing path 54 therebetween. The pusher piece advancing path 54 is provided with a staple striking mechanism 91 at its other end side.

(4) Feed Mechanism 70

The first side wall section 44 has an extension 44*a* at one end side so as to extend downward in the same plane as that of the first side wall section 44. Likely, the second side wall section 45 has an extension 45*a*. These extensions 44*a* and 45*a* of the first and second side wall sections 44 and 45 form a mount portion for the feed mechanism 70.

Figure 5:
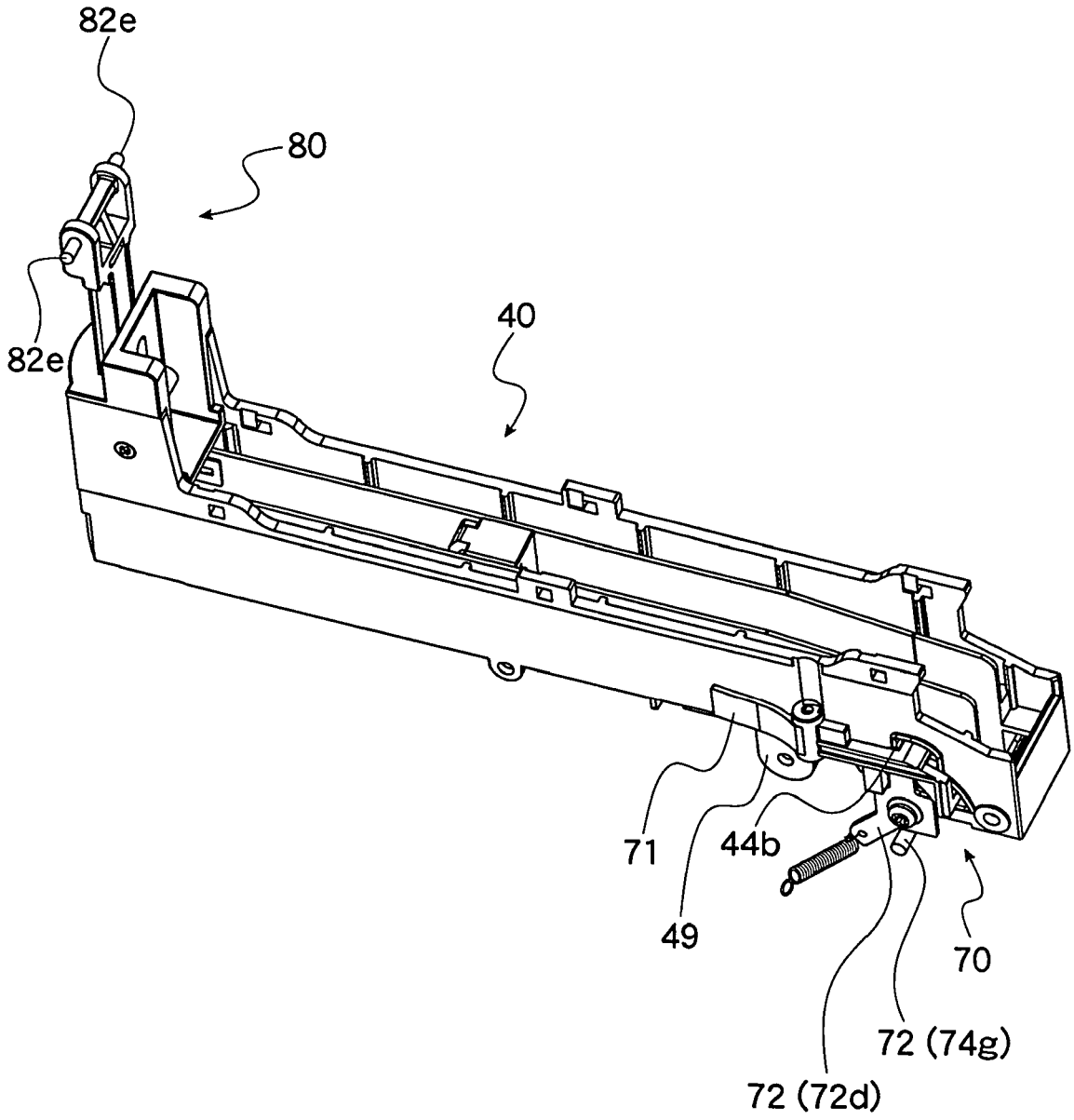
FIG. 5 is a perspective view showing an outer configuration of the staple mount magazine.
Figure 6:
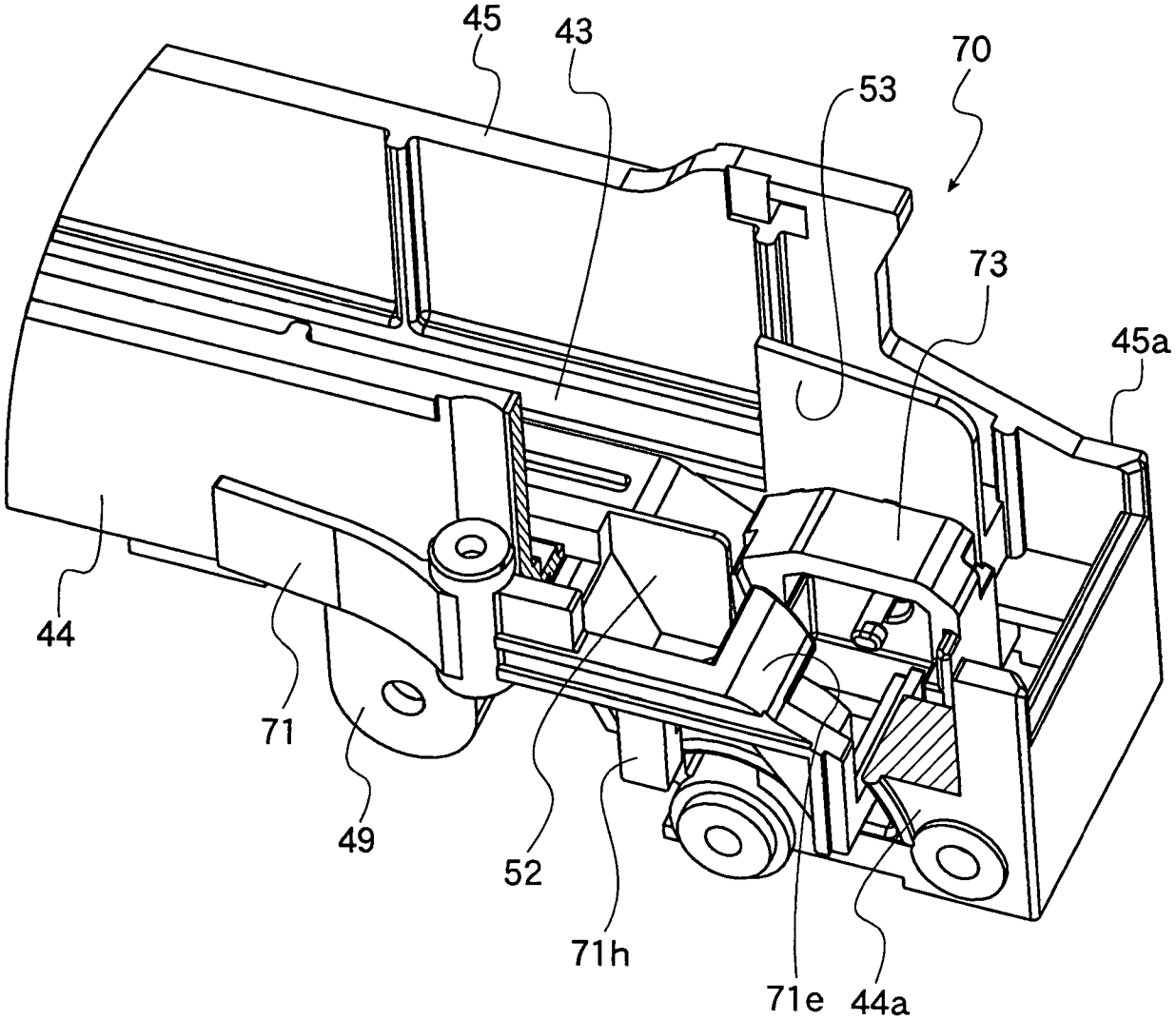
FIG. 6 is an enlarged perspective view showing a portion of a feed mechanism.

FIG. 5 is a perspective view showing the outer configuration of the staple mount magazine 40. FIG. 6 shows a portion of the feed mechanism 70 in an enlarged scale. In FIG. 6, the first side wall section 44, the first inside wall section 52 and the second inside wall section 53 are partially cut away.

The feed mechanism 70 includes the mount sensor 71, a release lever rotating plate 72, a pusher piece 73 and a lock mechanism 74. The mount sensor 71 serves to sense the mounting of the connected staple assembly cassette 100 inserted into the mount case body 41. The release lever rotating plate 72 senses the passing of the end portion of the connected staple assembly in the connected staple assembly cassette 100. The pusher piece 73 invades into the staple assembly cassette 100 and pushes the staple assembly toward the staple striking mechanism 80. The lock mechanism 74 serves usually to allow the pusher piece 73 to wait at a portion near the cassette insertion port 50.

Figure 7:
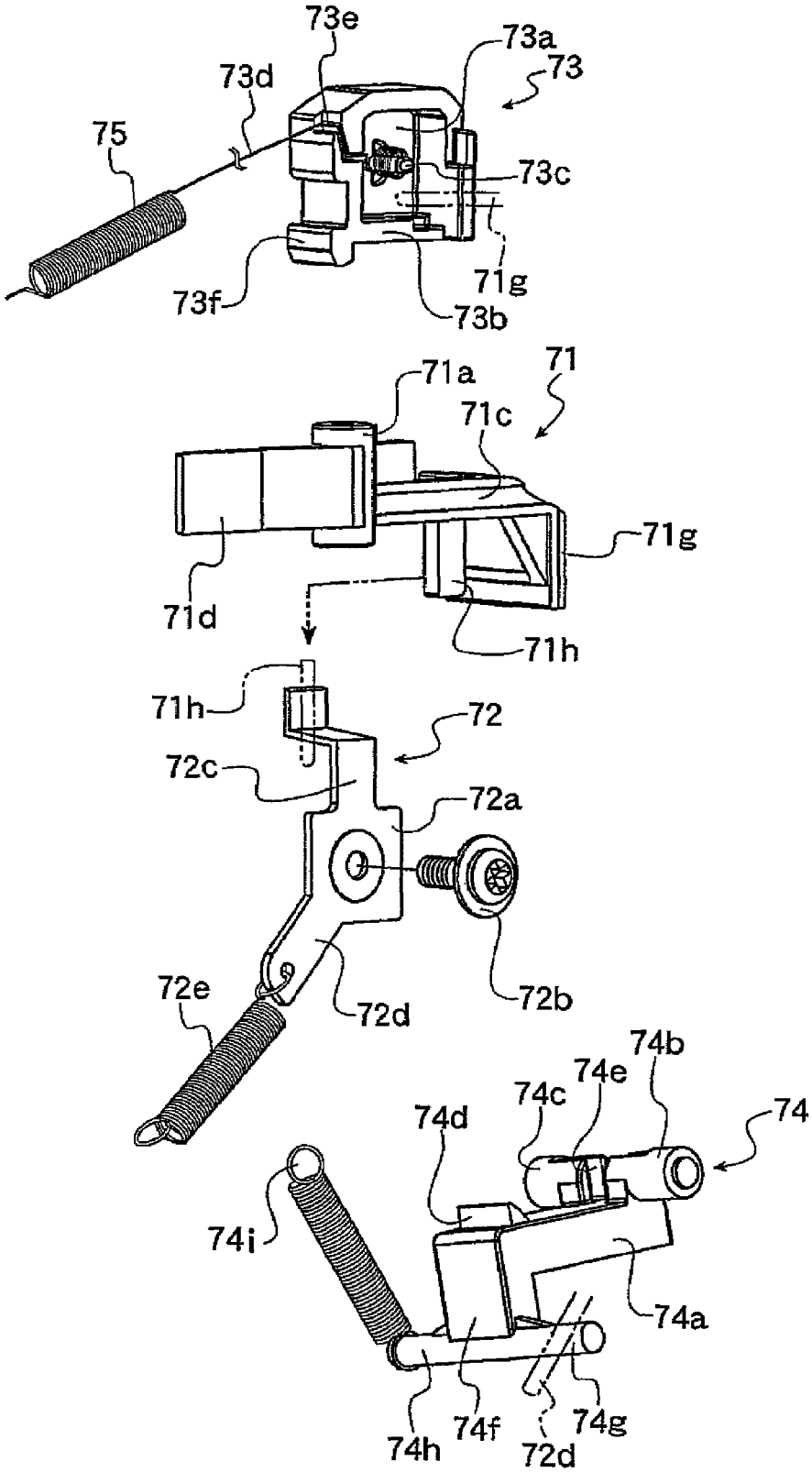
FIG. 7 is a developed perspective view of the feed mechanism.
Figure 8:
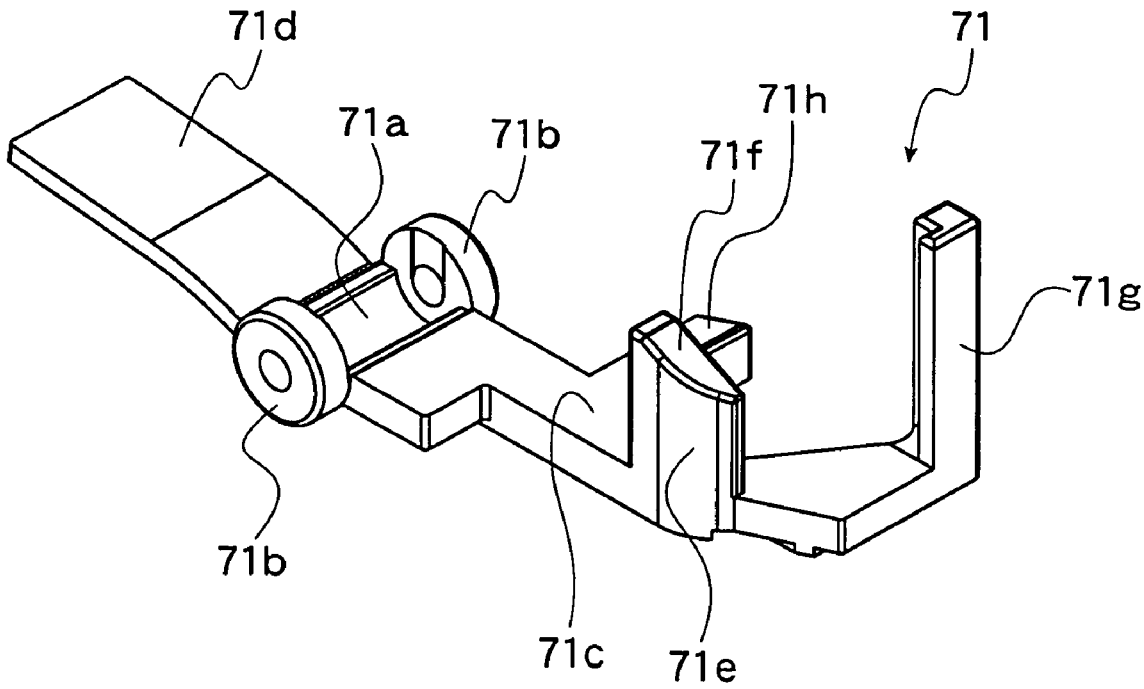
FIG. 8 is a perspective view showing an outer configuration of a mount sensor.

FIG. 7 shows a developed perspective view showing the feed mechanism 70. FIG. 8 is a perspective view showing the outer configuration of the mount sensor.

The mount sensor 71 is mounted to the outer surface of the first side wall section 44. The release rotating plate 72 is provided for the first extension 44*a* extending from the first side wall section 44. The lock mechanism 74 is provided horizontally between the first extension 44*a* of the first side wall section 44 and the second extension 45*a* of the second side wall section 45. The pusher piece 73 is provided on the lock mechanism 74 in a locking state.

i. Mount Sensor 71

The mount sensor 71 mentioned above has a semi-cylindrical member 71*a*, which is formed by vertically dividing a hollow cylindrical member in a plane including a central axis of the cylindrical body, and a pair of small discs 71*b*, 71*b* are attached to both side ends of the divided semi-cylindrical member 71*a*. These semi-cylindrical member and small discs 71*b*, 71*b* constitute a rotation center portion. The semi-cylindrical member 71*a* has a curved surface portion from which one end side plate 71*c* and other end side plate 71*d* extend in one and other end directions. The front end side portion of the other end side plate 71*d* extending in the other end direction is bonded to the first side wall section 44 at its portion so that the peripheral edge portion of the small disc 71*b* pushes elastically the first side wall section 44. The one end side plate 71*c* is narrowed in its vertical width on the way extending on one end direction, and a sensing projection 71*e* projects from the upper end edge of the narrowed width plate portion. This sensing projection 71*e* projects at a right angle toward the second side wall section 45, and a cut-out port 44*b* is formed to the first side wall section so as to correspond to the sensing projection 71*e*. The front end portion of the sensing projection 71*e* invades into the mount case body 41 through this cut-out port 44*b* and projects into a space between the first side wall section 44 and the first inside wall section 52. The front end portion 71*f* of the sensing projection 71*e* inclines in its one end direction. When something passes between the first side wall section 44 and the first inside wall section 52, the front end portion 71*f* receives this thing at its inclined surface and the mount sensor 71 is elastically deformed. Accordingly, the sensing projection 71*e* opens the passage between the first side wall section 44 and the first inside wall section 52.

Two stop arms extend downward at a lower peripheral edge of the plate piece extending horizontally in one end direction from the side edge portion of the semi-cylindrical member 71*a*, one being positioned at the front end of the plate piece and the other being positioned slightly near the other end side. The first stop arm 71*g* extends vertically from the front end portion is bent at its lower portion in L-shape. The bent horizontal portion invades through the cut-out port 44*b* formed to the first side wall section 44 and is engaged, at its front end portion, with the pusher piece 73 locked on the lock mechanism 74. The second stop arm 71*h* near the other end side is engaged with the release lever rotating plate 72. When the mount sensor 71 is displaced, the engagements of the above portions are released.

ii. Release Lever Rotating Plate 72

The release lever rotating plate 72 is mounted directly below the mount sensor 71. The release lever rotating plate 72 serves to detect, as a rear end sensing sensor, the passing of the rear end of the connected staple assembly accommodated in the connected staple assembly cassette 100.

The release lever rotating plate 72 has a square-shaped portion 72*a* at its central portion, which is screwed to be secured to the first extension 44*a* of one end side of the first side wall section 44 by means of a flanged screw 72*b*. The release lever rotating plate 72 has a rear end sensing arm 72*c* and a release arm 72*d*. The rear end sensing arm 72*c* extends vertically upward from an upper end center portion of the square-shaped portion 72*a* and is bent twice so that its front end projects into the advance passage 54 of the pusher piece 73 through the mount port of the feed mechanism 70 opened on one end side of the horizontal bottom plate 43 of the mount case body 41. The front end of the rear end sensing arm 72*c* projects into the advancing passage 54 so that sensing at this portion can be carried out. The rear end sensing arm 72*c* is engaged with the second stop arm 71*h* provided for the mount sensor 71 to be disengageable in the rotating direction. When engaged, the rear end sensing arm 72*c* is in a waiting position so as not to be rotated. The release arm 72*d* is provided with a first traction coil spring 72*e* drawing the release arm 72*d* in its longitudinal direction.

iii. Lock Mechanism 74

The lock mechanism 74 is provided with a horizontal lock door 74*a*, a first horizontal rotation shaft 74*b*, and a second horizontal rotation shaft 74*c* to thereby form a pusher piece engaging member. The first and second horizontal rotation shafts 74*b* and 74*c* are disposed at both ends in the width direction of the upper portion of one end side of the horizontal lock door 74*a*. The shafts 74*b* and 74*c* are facing to each other and positioned on one line, and engage and lock the pusher piece 73 at a portion near the cassette insertion port of the mount case body 41.

On the upper surface of the horizontal lock door 74*a*, a lock projection 74*d* and a guide projection 74*e* are formed so as to project there from to guide the pusher piece to its stop position at the time of returning. The guide projection 74*e* is positioned between the first horizontal shaft 74*b* and the second horizontal shaft 74*c* on the same line thereof. The lock projection 74*d* is positioned on the other side position of the horizontal lock door 74*a* and has a fine beam shape extending in the width direction thereof.

The horizontal lock door 74*a* includes a release wall section 74*f* suspended from the other end thereof as releasing means for releasing the engaged lock condition with the pusher piece 73. From both sides of the lower end of the release wall section 74*f* a door open arm 74*g* and a door close arm 74*h* are disposed so as to project in the horizontal direction. The door open arm 74*g* is positioned directly below the first side wall section 44 of the mount case body 41. The position corresponds to the rotating direction of the release arm 72*d*. When the release arm 72*d* is rotated, the door open arm 74*g* is pushed by the release arm 72*d*, and the horizontal lock door 74*a* is opened and the engagement between the horizontal lock door 74*a* and the pusher piece 73 is released. The door close arm 74*h* is positioned directly below the second side wall section 45 of the mount case body 41, and is drawn upward by the door close coil spring 74*i* to thereby maintain the horizontal lock door 74*a* to be horizontal.

iv. Pusher Piece 73

The pusher piece 73 is composed of a piece plate body 73*a* and a piece peripheral wall section 73*b*. The piece plate body 73*a* is formed by rounding corner portions of a rectangular plate to eliminate angled corner portions. The piece peripheral wall section 73*b* surrounds the periphery of the piece plate body 73*a* so as to form a recess therein. The piece plate body 73*a* stands vertically and piece peripheral wall section 73*b* has an upper end directed to the first side wall section 44 by vertically forming the piece plate body 73*a*. A string engaging projection 73*c* is formed to the central recess of the piece plate body 73*a*. A traction string 73*d* is fixed, at its one end, to the string engaging projection 73*c*, and a string passing groove 73*e* is formed to the piece peripheral wall section 73*b*. The traction string 73*d* passes through the string passing groove 73*e* and extends in the other end direction. The piece peripheral wall section 73*b* is further provided with a peripheral projection 73*f* engageable with the lock projection 74*d* of the lock mechanism 74. The recess surrounded by the piece peripheral wall section 73*b* engages with the first stop arm 71*g* of the mount sensor 71.

The other end side of the traction string 73*d* passing through the string passing groove 73*e* of the string peripheral wall section 73*b* passes in the advance passage 54 of the pusher piece 73. The traction string 73*d* then extends toward the other end side in the advance passage 54 in the pusher piece 73 along the upper surface of the horizontal bottom plate 43 and then vertically penetrates the horizontal bottom plate 43. A pusher piece traction spring 75 is provided to the rear surface of the horizontal base 31 and elastically connected thereto. The pusher piece 73 is drawn to the other end side in the pusher piece advance passage 54 by the traction force of the pusher piece traction spring 75. That is, as shown in FIG. 3, the pusher piece 73 intrudes into the rear surface from the string passing hole 32*b* opened to the horizontal flat plate 32 and is elastically drawn by the pusher piece traction spring 75 formed to the rear surface of the horizontal flat plate 32.

(5) Staple Striking Mechanism 80

The staple striking mechanism 80 includes a blade push-down mechanism 81 and a staple strike-in mechanism 91. The blade push-down mechanism 81 is provided to the lower surface of the operation handle 60. The staple strike-in mechanism 91 serves to adjust and select the staple to be struck in the mount case body 41. The staple striking mechanism 80 serves to strike the staple in the connected staple assembly cassette 100 fed to the other end side thereof directly into the paper.

i. Blade Push-down Mechanism 81

Figure 9:
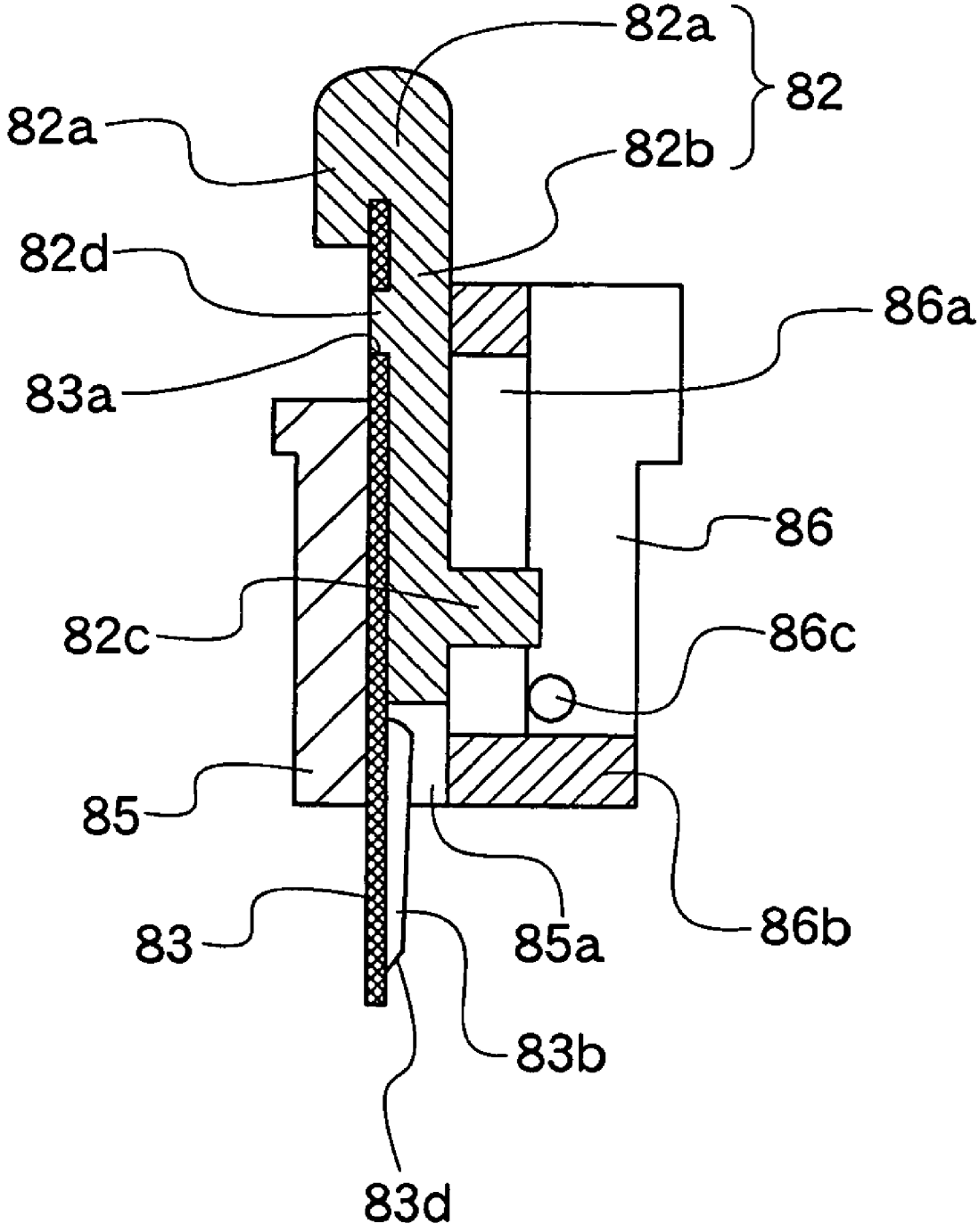
FIG. 9 is an elevational section of a blade holder.
Figure 10:
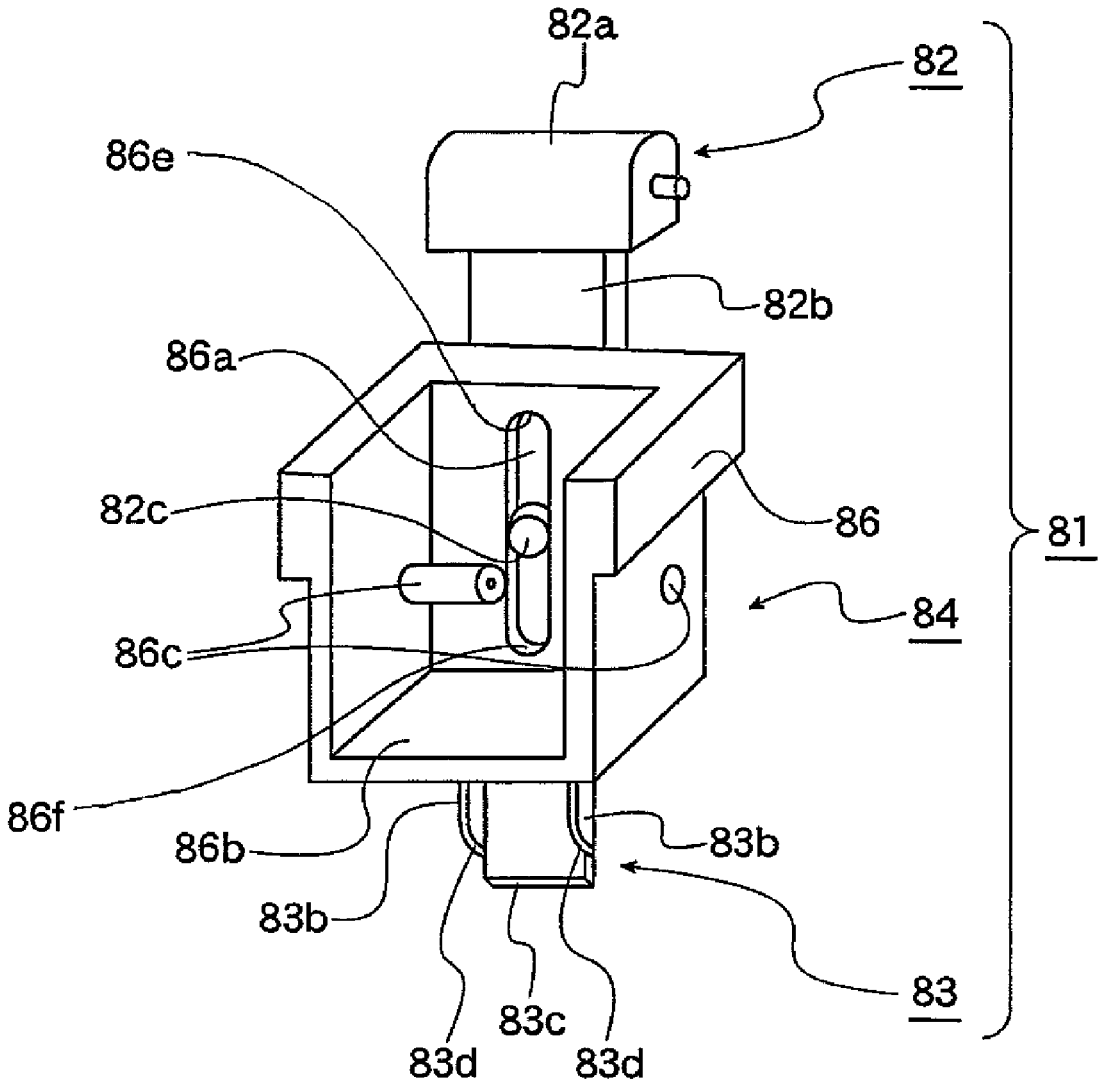
FIG. 10 is a perspective view showing an outer configuration of a blade push-down mechanism.

The structure of the blade push-down mechanism 81 is schematically shown in FIG. 4 as developed view. The blade push-down mechanism 81 includes a blade holder 82, a staple striking blade plate 83 and a blade guide pad 84. The blade guide pad 84 is incorporated with a staple striking blade lowering slit 85*a*. FIG. 9 shows an elevational section of the blade holder. FIG. 10 shows the outer configuration of the blade push-down mechanism 81.

The blade holder 82 includes a head portion 82*a* formed by swelling an upper portion thereof. The blade holder 82 has a shaft-shaped tail portion 82*b* in the form of vertically long columnar portion, which is integrated with the head portion 82*a*. The head portion 82*a* has a slightly wide width in the same direction as the width direction of the horizontal base 31 and is coupled to be rotatable on both sides in the width direction of the operation handle 60. The coupling position is located at the other end side from the handle pivot shaft member 61. The head portion 82*a* is elastically pulled upward by the push-down twist coil spring 62 to a position higher than the handle pivot shaft member 61, and when the operation handle 60 is depressed, it is lowered in association therewith.

The tail portion 82*b* of the blade holder 82 is formed with projections on one and the other surface sides. On one side surface, a guide projection 82*c* is formed at relatively low position and on the other surface side, a blade projection 82*d* is formed.

On the other surface side of the blade holder 82, a staple striking blade plate 83 is mounted to the blade projection 82*d* so as to be integral therewith. The vertically extending staple striking blade plate 83 has a thickness entirely smaller than the thickness of the staple and is formed with an engaging hole 83*a* engageable with the blade projection 82*d*, and the blade projection 82*d* of the tail portion 82*b* is engaged with the engaging hole 83*a*.

Both the lower side portions in the width direction of the vertically extending staple striking blade plate 83 are bent with respect to the plate surface at a right angle in one end direction. The bent portions constitute side wall sections 83*b* each having a thickness larger than that of base portion 83*c*. The bent width is larger than the diameter of one staple and smaller than the width of connected two staples. The lower ends of the bent portions of the side wall sections form downward inclining portions 83*d*.

The blade holder 82 and the staple striking blade plate 83 are accommodated together in the blade pad 84 to be vertically movable. In the blade pad 84, the tail portion 82*b* of the blade holder 82 and the staple striking blade plate 83 are clamped by two plate members. The other end side is formed of the other end side member 85 and the one end side is formed of the one end side member 86. To the other end side member 85, the blade plate lowering slit 85*a* penetrating in the vertical direction is formed. The tail portion 82*b* and the staple striking blade plate 83 are accommodated in this vertically penetrating blade plate lowering slit 85*a* to be vertically slidable.

The one end side member 86 is formed with a vertically extending blade plate lowering and elevating slit 86*a* in a range from the upper end to the lower end thereof. The tail portion 82*b* of the blade holder 82 contacting one end side member 86 serves such that the guide projection 82*c* projects into the blade plate lowering and elevating slit 86*a*. The tail portion 82*b* closely contacting the staple striking blade plate 83 has an upper end, as upper dead center 86*e*, to which the guide projection reaches in the blade plate elevating slit 86*a* and a lower end, as lower dead center 86*f*, to which the guide projection 82*c* reaches. The blade holder 82 is vertically movable in the range of the upper and lower dead centers, and the staple striking blade plate 83 is also movable in this range.

The thus formed blade pad 84 is mounted to the staple striking opening at which the short top plate 47 of the mount case body 41 is opened. The one end side member 86 of the blade pad 84 has a peripheral wall section 86*b* surrounding the periphery thereof. The other end sides of the first and second side wall sections 44 and 45 of the mount case body 41 are provided with the other end side extensions 44*c*, respectively, directing upward. These other end side extensions 44*c* and 45*c* and peripheral wall section 86*b* of the one end side member 86 are fastened together by means of screw 41*a* screwed into a screw hole 86*c*.

ii. Staple Strike-In Mechanism 91

The staple strike-in mechanism 91 is disposed at the other end portion of the mount case body 41 below the blade pad 84. FIG. 4 shows the position of the staple strike-in mechanism 91 with the developed perspective view. The mount case body 41 is provided with the first inside wall section 52 and the second inside wall section 53, and an inside wall fitting cover 55 for supporting these wall sections is mounted on the other end side. The inside wall fitting cover 55 is provided with a first abutting surface 55*a* and a second abutting surface 55*b*. The first abutting surface 55*a* holds the first inside wall section 52, and the second abutting surface 55*b* holds the second inside wall section 53. The other side surface 55*c* is formed between the first abutting surface 55*a* and the second abutting surface 55*b*, and the inside wall fitting cover 55 surrounds the three sides. Three sides of the staple strike-in mechanism 91 is surrounded by the inside wall fitting cover 55. The staple strike-in mechanism 91 is clamped between the first inside wall section 52 and the second inside wall section 53 held by the inside wall fitting cover 55.

Figure 11:
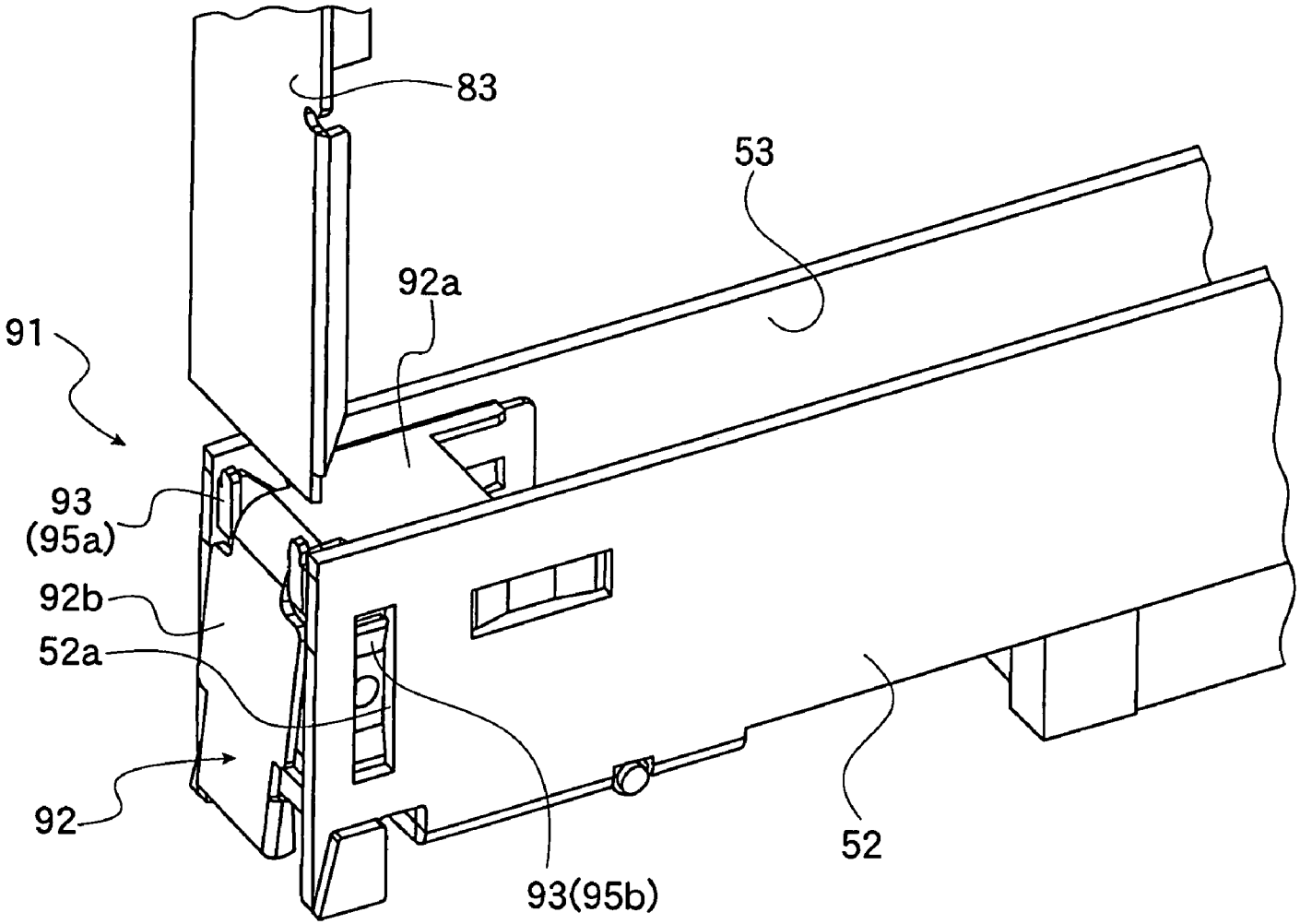
FIG. 11 is a perspective view showing essential portions of a staple striking blade plate and a staple striking portion.
Figure 12:
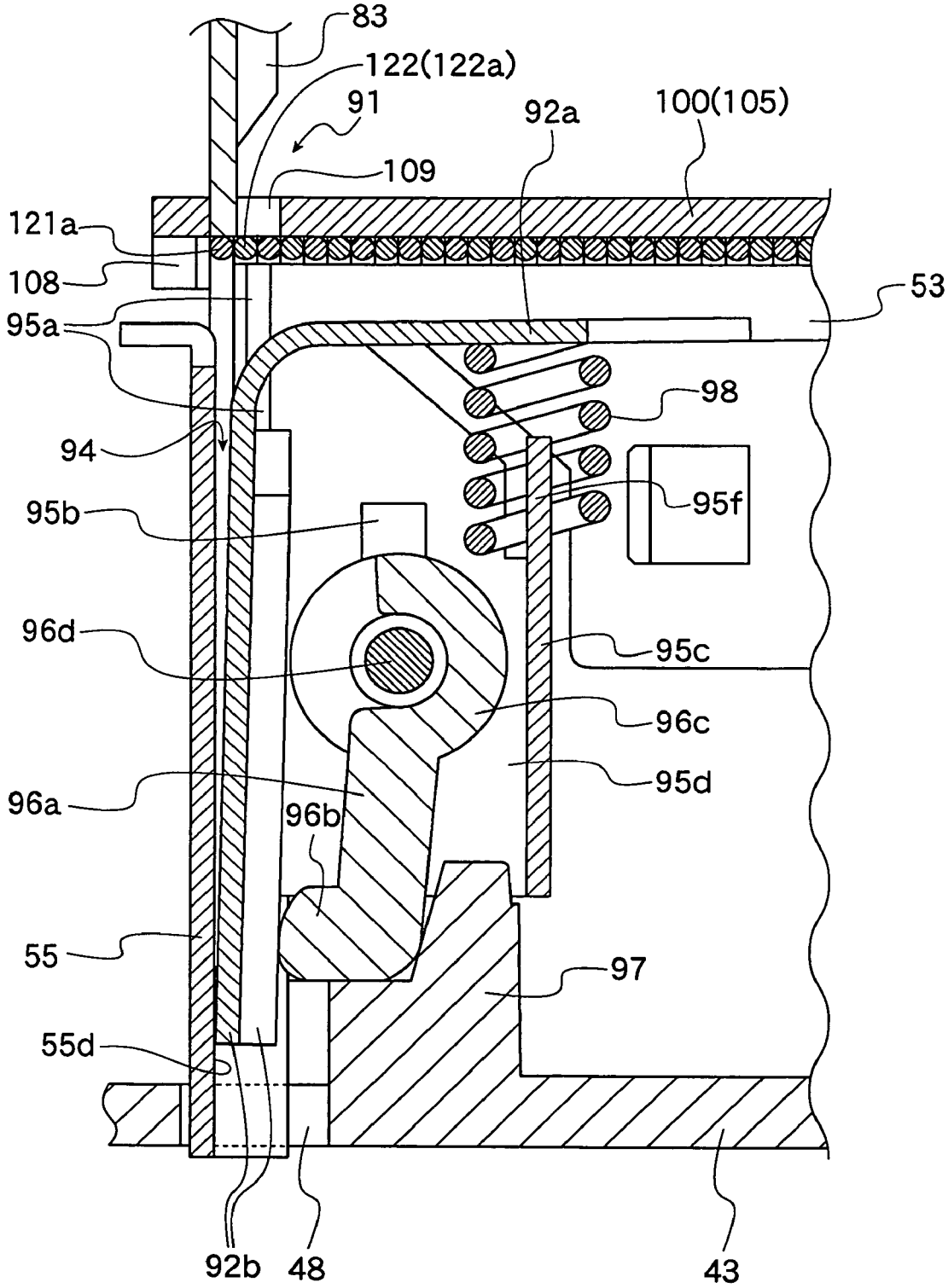
FIG. 12 is a sectional view of the staple striking portion.

FIG. 11 is a perspective view of an essential portion showing the relationship between the staple striking blade plate 83 and the staple striking portion 91. FIG. 11 shows the state in which the first side wall section 44, the second side wall section 45, the inside wall fitting cover 55 and the horizontal bottom plate 43 are removed. FIG. 12 shows a sectional view of the staple striking portion 91, in which the connected staple assembly cassette 100 is mounted.

The staple striking portion 91 includes a plate spring wall sensor 92 and an advancing movement blocking mechanism 93. The plate spring wall sensor 92 detects the lowering movement of one staple 121 on the most other end side, which is pushed down by the staple striking blade plate 83. The advancing movement blocking mechanism 93 blocks the advancing of the next staple 122. The staple striking portion 91 serves to adjust and select the staple to be struck in the mount case body 41.

a. Plate Spring Wall Sensor 92

The plate spring wall sensor 92 is formed as a plate spring type staple sensor, in which a rectangular elastic plate spring member is bent in an obtuse angle near the right angle, not an acute angle, so as to provide an L-shape. The plate spring wall sensor 92 has a horizontal portion 92*a* and a vertical portion 92*b*, and the horizontal portion 92*a* is mounted inside the first and second inside wall sections 52 and 53 at a portion almost near the upper end edge thereof to be horizontally. The vertical portion 92*b* is positioned at the other end side front end portion of the first and second inside wall sections 52 and 53. The vertical portion 92*b* has one end side surface and the other end surface as front and back plate surfaces. The both end edges of the plate surfaces are clamped by the first and second inside wall sections 52 and 53 so as to be positioned inside thereof. Between both the inside wall sections 52 and 53, there exists a space having at least a width through which at least one staple 101*a* can pass and contacts thereto. The lower end of the vertical portion 92*b* protrudes toward the other end side front ends of the first and second inside wall sections 52 and 53, and the lower end protruding from the front end portions elastically contacts the other end side surface 55*d* as a perpendicular stationary wall section. Thus, a staple lowering slit 94, always closed, having both sides formed by the other end side surface 55*d* of the inside wall fitting cover 55 and the vertical portion 92*b*, is formed.

The staple has an upper horizontal portion and both leg portions which are bent so as to provide an inverted U-shape. The staple lowering slit 94 is formed to be capable of being elastically opened or closed so that the plate spring wall sensor 92 is opened by an amount corresponding to the thickness of the inserted staple 121 when the upper horizontal portion 121*a* of the most other end side staple 121 is inserted.

The lower end of the staple lowering slit 94 extends to the staple lowering slit opening 48 opened on the other end side of the horizontal bottom plate 43 of the mount case body 41 and the anvil 35 is positioned therebelow. The vertical dimension of the staple striking blade plate 83 has a length such that the lower end thereof reaches the anvil 35 when the operation handle is depressed.

b. Advancing Movement Blocking Mechanism 93

The advance movement blocking mechanism 93 is composed in combination of a vertically moving member 95, a push-up member 96, an inclination surface projection 97 and a vertical coil spring 98.

The vertically moving member 95 blocks the advancing of the staple 101*a*. The push-up member 96 is pushed upward together with the vertically moving member 95. The inclination surface projection 97 supports the push-up member from the lower side thereof. The staple striking blade plate 83 depresses the upper horizontal portion 121a of the most other end side staple 121 into the staple lowering slit 94. During this operation, the advancing movement blocking mechanism 93 blocks the advancing of the neighbour staple 122.

In the advancing movement blocking mechanism 93, cut-outs are made on both sides of the bent portion of the plate spring wall sensor 92, and from these cut-outs, a vertical movement projection 95*a* projects to be vertically advanced or retired. In addition, a guide slit 52*a* is formed to the first inside wall section 52 in the vertical direction, a guide slit is also formed to the second inside wall section 53 in the vertical direction, and the guide projection 95*b* of the advancing movement block mechanism 93 projects from the guide slit.

Figure 13:
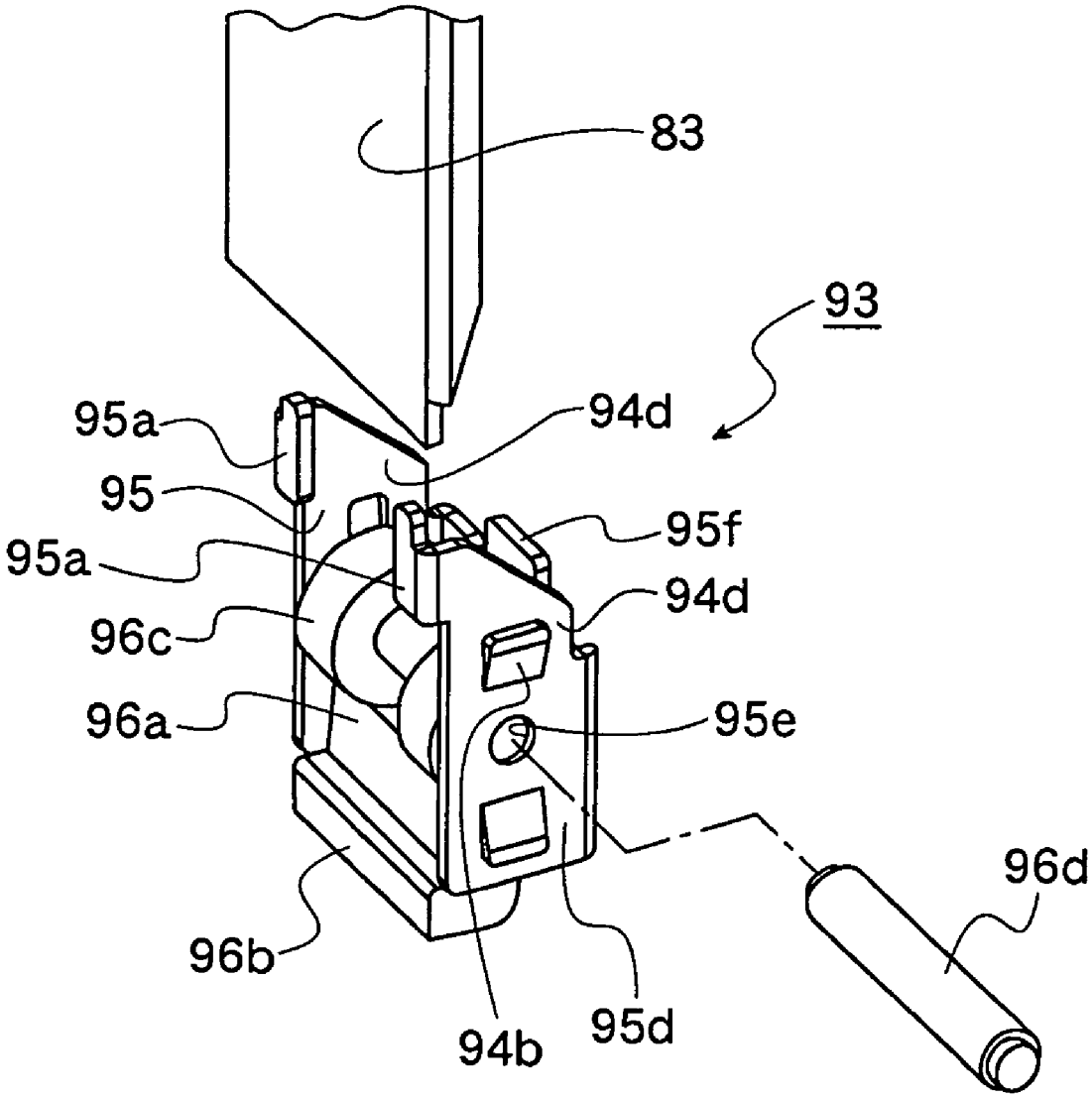
FIG. 13 is a perspective view showing essential portions of the staple striking blade plate and an advance-movement blocking mechanism.
Figure 14:
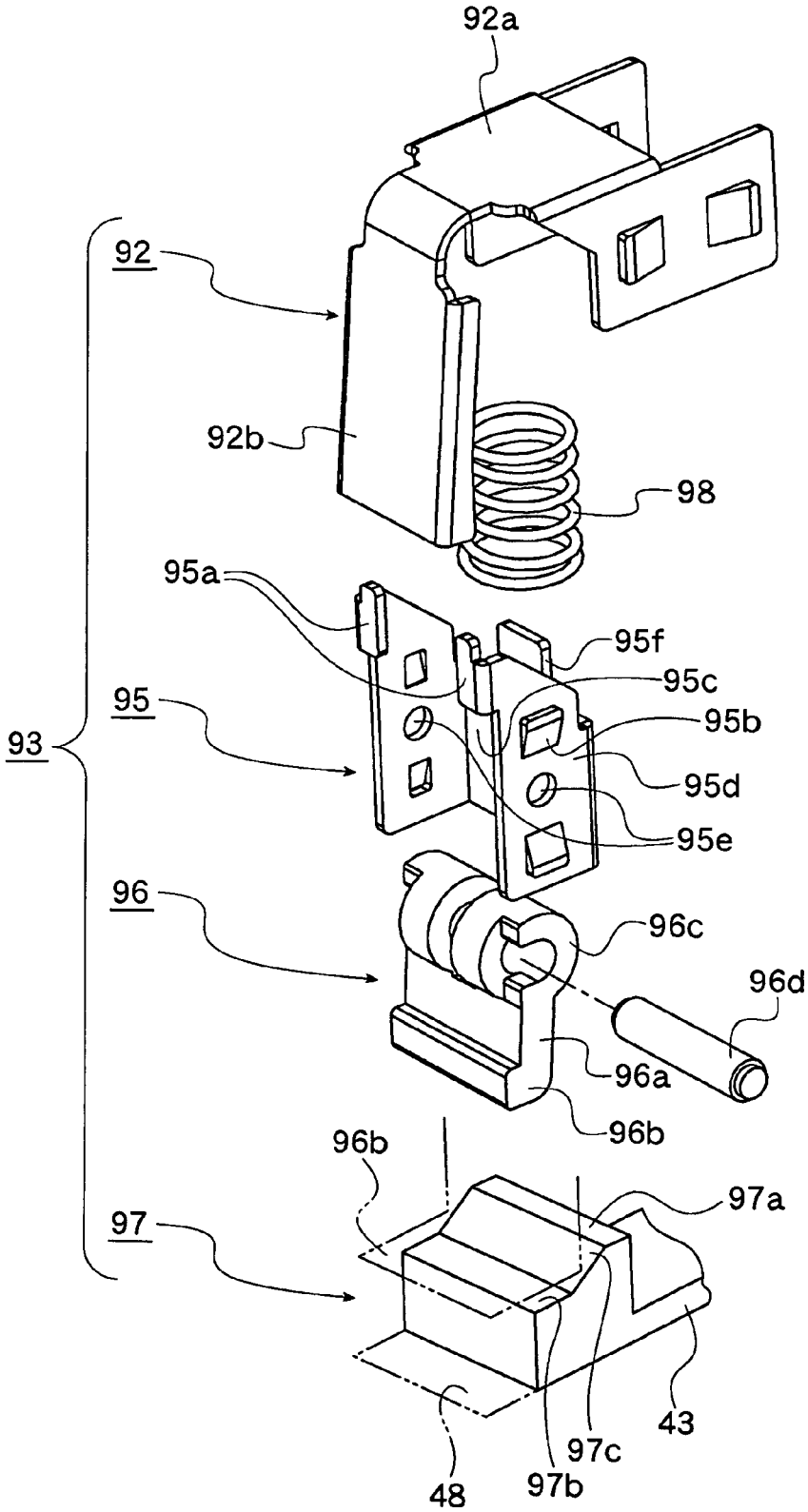
FIG. 14 is a developed view showing the staple striking blade plate and the advance-movement blocking mechanism.

FIG. 13 shown the outer configuration of the staple striking blade plate 83 and the advancing movement block mechanism 93. FIG. 14 shows the developed view of the staple striking blade plate 83 and the advancing movement blocking mechanism 93.

① Vertical Movement Member 95

The vertically movable member 95 forms a peripheral wall section in three directions together with the one end side wall 95*c* in the one end side direction and two adjacent wall sections 95*d* of this one end side wall section 95*c*. The adjacent wall sections 95*d*, being parts of the three directional peripheral wall section, are clamped between the inside portions of the first and second inside wall sections 52 and 53 so as to almost contact them. Both the adjacent wall sections 95*d* clamped between the first and second inside wall sections 52 and 53 are provided with guide projections 95*b* projecting from the outer surfaces thereof. The guide projections 95*b* are formed to the upper and lower portions. These projections are engaged with the guide slit 52*a* formed to the first inside wall section 52 and a guide slit formed on the other end side of the second inside wall section 53 to be vertically slidable within a predetermined vertical width range. In addition, both the adjacent wall sections 95*d* are provided with vertically movable projections 95*a* to be capable of being advanced or retired from the upper end of the plate spring wall sensor 92.

② Push-up Member 96

The push-up member 96 is provided with a thickened vertical plate piece 96*a* being widened in the width direction of the horizontal base 31, and has a lower end portion 96*b* bent in L-shape in the other end side direction. The L-shaped vertical plate piece 96*a* had an upper end edge to which a tube shaft passage 96*c* is formed. The tube shaft passage 96*c* has a shaft extending horizontally in the length direction of the upper end edge of the vertical plate piece 96*a* and an insertion shaft 96d being passed through the tube shaft passage 96*c*. Both ends of the insertion shaft 96*d* are horizontally engaged, to be rotatable, with the shaft holes 95*e* opened to the adjacent wall sections 95*d* of the vertically movable member 95. According to this arrangement, the push-up member 96 is suspended to be rotatable between both the adjacent wall sections 95*d* of the vertically movable member 95, and the lower end portion 96*b* contacts a portion of the plate surface at one end side of the vertical portion 92*b* of the plate spring wall sensor 92.

③ Inclination Surface Projection 97

The inclination surface projection 97 is formed so that a portion of the upper surface of the horizontal bottom plate 43 of the mount case body 41 projects vertically in the feeder mount passage 51 between the first side wall section 44 and the second side wall section 45. The horizontal bottom plate 43 is formed, at its other end side, with the staple lowering slit opening 48. The inclination surface projection 97 has a front end surface contacting the staple lowering slit opening 48. The staple lowering slit opening 48 has a groove width between an opening edge of one end side and an opening edge of the other end side, and the front end surface of the inclination surface projection 97 is mated with the opening edge of the one end side of the staple lowering slit opening 48. Further, the lower end of the push-up member 96 contacts the upper portion of the inclination surface projection 97.

The inclination surface projection 97 has a staged structure. That is, two steps of upper step surface 97*a* and intermediate step surface 97*b* as upward facing surfaces corresponding to foot steps of a corridor are vertically formed. The upper and intermediate step surfaces 97*a* and 97*b* have their border of a step-up surface 97*c* extending in the perpendicular direction, and on both sides of this border step-up surface 97*c*, the upper step surface 97*a* is directed to one end side, and the intermediate step surface 97*b* is directed to the other end side. To the L-shaped corner portion between the intermediate step surface 97*b* and the step-up surface 97*c*, the lower end portion 96*b* of the push-up member 96 is contacted. Further, the step-up surface 97*c* is provided with an upward inclination which is face to the other end side direction.

The intermediate step surface 97*b* is formed as a lower dead center of the push-up member 96. When the plate spring wail sensor 92 pushes the lower end portion 96*b* of the push-up member 96 horizontally against the inclination surface projection 97, the push-up member 96 moves upward along the inclined pick-up surface 97*c* thereof. 4̂ Vertical Coil Spring 98

The vertical coil spring 98 serves to generate an elastic force in the vertical direction, and its lower end engages with the upper end portion of the vertically movable member 95 and its upper end contacts the lower surface of the horizontal portion 92*a* of the plate spring wall sensor 92. That is, the one end side wall section 95*c* of the vertically movable member 95 is provided, at its upper end, with a coil spring engaging projection 95*f* projecting upward, and the coil spring engaging projections 95*f* is inserted into the lower end of the vertical coil spring 98. According to this structure, the vertical coil spring 98 serves to elastically suppress the upward movement of the vertically movable member 95 connected to the push-up member 96 along the inclining surface of the inclination surface projection 97.

(6) Connected Staple Assembly Cassette 100

Figure 15:
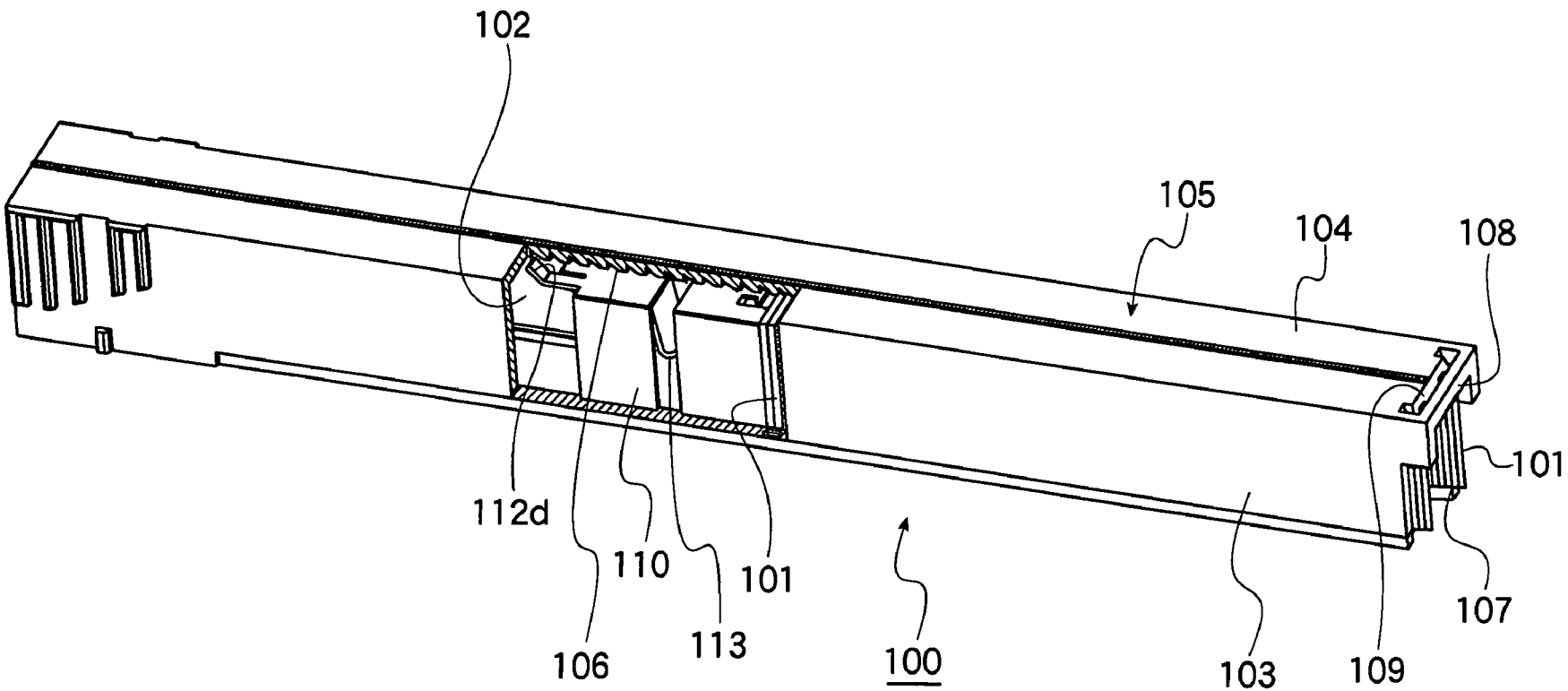
FIG. 15 is a perspective view, partially cut away, of a connected staple assembly cassette.
Figure 16A:
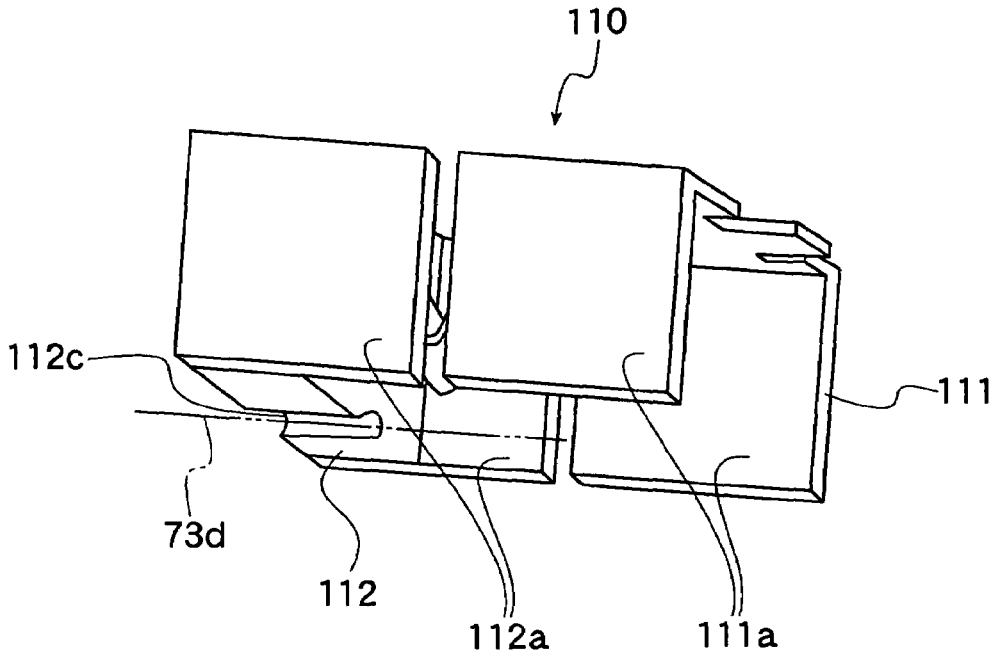
FIG. 16A is a perspective view of a reverse- (retire) movement stop feeder.
Figure 16B:
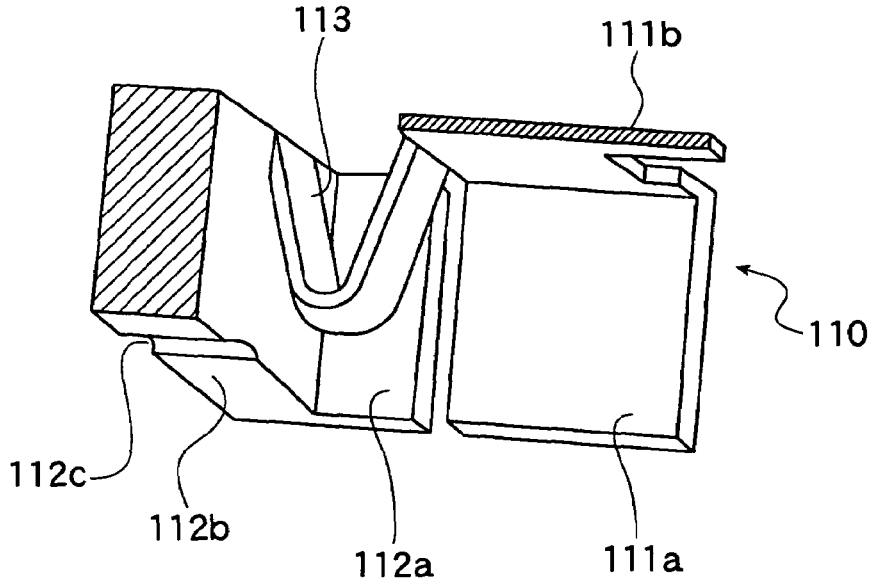
FIG. 16B is a sectional view showing a central portion of the reverse-movement stop feeder.
Figure 17:
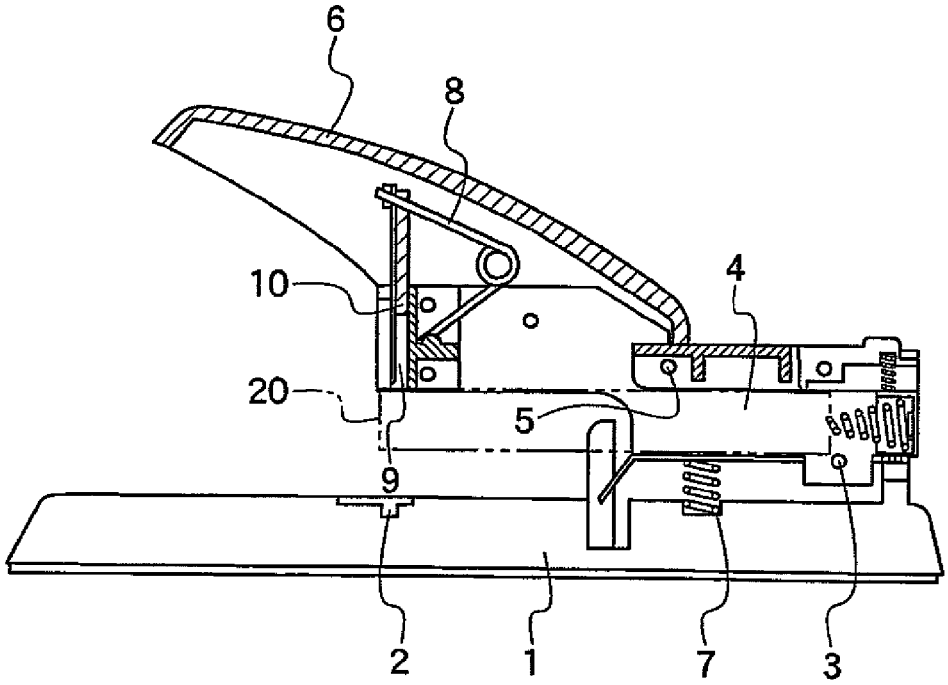
FIG.17 ( prior art )
FIG. 17 is a sectional view of one example of a conventional stapler.
Figure 18:
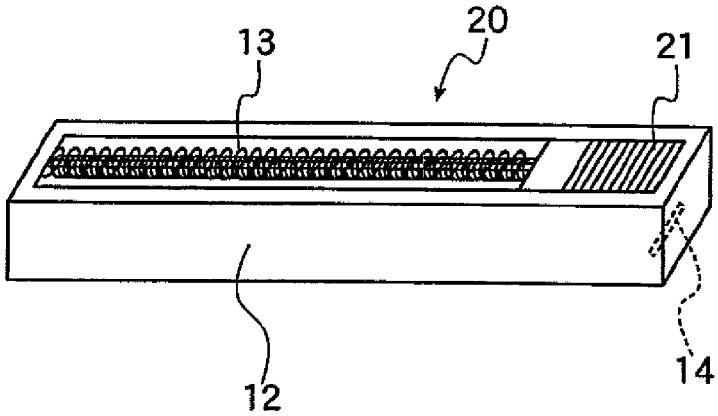
FIG.18 ( prior art )
FIG. 18 is a perspective view of a conventional connected staple assembly cassette.

FIG. 15 is the perspective view, partially cut away, of the connected staple assembly cassette 100, FIG. 16A is the perspective view of the reverse movement stop feeder 110, and FIG. 16B is the sectional view of the reverse movement stop feeder 110.

i. Outer Configuration

The connected staple assembly cassette 100 serves to accommodate and store a connected staple assembly 100 including a number of staples each having almost U-shape having a right angled corner portions. This staple assembly cassette 100 is a unit for mounting the staple assembly 101 in the staple mount magazine 40. The staple assembly cassette 100 is provided with a reverse movement stop feeder 110 on the other end side of the stapling operation so that the connected staple assembly 101 which should advance forward is not moved backward.

The connected staple assembly cassette 100 has a first wall plate 102 and a second wall plate 103 which extend from one end side toward other end side to be parallel with each other as both side wall plates. A horizontally flat cassette top plate 104 is disposed on both the wall plates so as to extend from one end side toward the other end side. Both the wall plates 102, 103 and the cassette top plate 104 constitute, as an integral structure, a cassette case body 105. The first wall plate 102 of the cassette case body 105 is formed so as to be inserted through a portion between the first side wall section 44 of the staple mount magazine 40 and the first inside wall section 52 thereof. Likely, the second wall plate 103 is formed so as to be inserted through a portion between the second side wall section 45 and the second inside wall section 53. The distance from the lower end of each of the cassette wall plates to the upper end of the cassette top plate 104 is equal to the inside height of the mount case body 41. According to such structure, the cassette case body 105 can be smoothly moved into the mount case body 41 through the cassette insertion port 50 thereof.

ii. Interior Structure

On the rear side of the slender cassette top plate 104, engaging irregular (convex-concave) portion 106, with which the reverse movement stop feeder 110 is engaged, is formed in a series of connected bead form in the transverse direction. The engaging irregular portion 106 has a W-shaped section and has an inclination surface inclining in the other end side direction, i.e., staple advancing direction and a perpendicular surface, both surfaces being alternately continued.

Rails 107 are provided for the lower ends of the first and second wall plates 102 and 103. The rails 107 extend in the longitudinal direction of the lower end edges of the first and second wall plates 102 and 103. These rails 107 project inward the first and second wall plates each by a distance corresponding to the width of the rail 107. According to such structure, a moving path of the connected staple assembly 101 and the reverse movement stop feeder 110 is formed. At the other end edge of the cassette top plate 104, a stop edge 108 having a projection projecting slightly downward is formed so as to project by a certain width of a straight stripe to thereby prevent the connected staple assembly 101 from coming off from the other end thereof.

The connected staple assembly 101 is accommodated inside the cassette case body 105 covered, from three directions, with the horizontally extending first and second wall plates 102 and 103 and the cassette top plate 104. The connected staple assembly 101 includes a number of staples, extending from one end side to the other end side, each having an approximately U-shape having corner portions bent at right angle. The connected staple assembly 101 is disposed such that both ends of the connected respective staples are rested on the rails of the first and second wall plates 102 and 103 to be slidable. The front end staple on the other end side of the connected staple assembly 101 is engaged with the stop edge 108 projecting from the other end edge of the cassette top plate 104. Further, the cassette top plate 104 adjacently contacts the stop edge 108 so as to open an advance/retire slit 109. The advance/retire slit 109 is located at a range where the upper end portion of the front end staple of the other end side is pushed, and the width of the advance/retire slit 109 is formed so as to have a wide width to thereby make the staple striking blade plate advance or retire. According to this structure, an exposed portion, at which the upper end of the front end staple of the other end side is exposed, is formed.

iii. Reverse-Movement Stop Feeder 110 a. Proceeding Piece 111

The reverse movement stop feeder 110 is disposed inside the cassette case body 105. The reverse movement stop feeder 110 connects elastically a proceeding piece 111 to a following (fellow-up) piece 112 following the proceeding piece 111 by means of elastic coupling portion 113. The slide returning movement in the one end side direction and the coming-off from one end side are prevented by an irregular (concave-convex) portion 106 (to be described later) of the cassette case body 105.

The proceeding piece 111 abuts against the one end side staple positioned at the most rear end portion of the connected staple assembly 101. The proceeding piece 111 provides substantially U-shape by two proceeding wall plates 111*a*, 111*a* and a proceeding top plate 111*b*. One of the proceeding wall plates 111*a* abuts against the first wall plate 102 of the cassette case body 105 and has a lower end slidably rested on the rail 107 of the first wall plate 102. The other one of the proceeding wall plates 111*a* abuts against the second wall plate 103 and has a lower end slidably rested on the rail 107 of the second wall plate 103. The proceeding top plate 111*b* is positioned on the back side of the cassette top plate 104 of the cassette case body 105.

b. Following Piece 112

The following piece 112 is positioned on one end side slightly apart from the proceeding piece 111. The following piece 112 is, like the proceeding piece 111, provided with two following wall plates 112*a*, 112*a*, and a collision plate 112*b* is connected in the form of horseshoe so as to be opened in the direction of the proceeding piece 111. One of the following wall plates 112*a* abuts against the first wall plate 102 of the cassette case body 105 and has a lower end slidably rested on the rail 107 of the first wall plate 102. The other one of the proceeding wall plates 111*a* abuts against the second wall plate 103 and has a lower end slidably rested on the rail 107 of the second wall plate 103. The collision plate 112*b* has a lower end in which a guide slit 112*c* for the traction string 73*d* of the pusher piece 73 is formed. The traction string 73*d* of the pusher piece 73 passes through this slit when the connected staple assembly cassette 100 is mounted to the staple mount magazine 40. The proceeding top plate 111*b* is positioned on the back side of the cassette top plate 104 of the cassette case body 105.

The following wall plate 112*a* has an upper portion to which a pawl projection 112*d* is formed. The following wall plate 112*d* has an elastic inclination portion. This inclination portion is formed to be engageable with the irregular (concave-convex) portion 106 formed to the cassette top plate 104, and is slid with respect to the force from the one end side toward the other end side and is engaged to resist against the force from the other end side toward one end side.

c. Connection Member 113

The proceeding piece 111 and the following piece 112 are coupled by means of the elastic connection member 113. The connection member 113 has a flexible structure formed by bending, in almost V-shape, an elastic rod member having slight rigidity so that the lower end bent portion provides a circular-arc shape in a side view which gives the elastic connection member more flexibility. One portion of the upper end of the connection member 113 is joined to one portion of the proceeding top plate 111*b* of the proceeding piece 111, and another portion of the upper end thereof is joined to the upper portion of the collision plate 112*b* of the following piece 112.

Hereunder, the functions of the stapler and the connected staple assembly cassette of the structures mentioned above will be described with reference to the embodiment shown in the accompanying drawings.

The staple mentioned above functions as follows.

The operation handle 60 is supported by a pair of handle stands 33 and 34 through the handle pivot shaft 61 and its other end side is held upward by the push-down twist coil spring 62. The blade holder 82 is positioned on the other end side of the handle pivot shaft 61, is attached to the operation handle 60 directed upward and stops above the horizontal base 32. The one end side member 86 of the blade guide pad 84 is suspended from the tail portion 82*b* of the blade holder 82. The connected staple mount magazine 40 is mounted to the horizontal base 31 through the mount portion pivot shaft member 49 disposed on one end side, and the other end portion of the mount case body 41 has the other end side extensions 44*c* and 45*c*. In the staple mount magazine 40, these other end side extensions 44*c* and 45*c* are fastened to the blade guide pad 84 so as to be lifted up therefrom.

The connected staple assembly cassette 100 is introduced through the cassette insertion port 50 on one end side of the mount case body 41 toward the other end side. The first wall plate 102 of the connected staple assembly cassette 100 is inserted between the first side wall section 44 and the first inside wall section 52 of the mount case body 41. The first wall plate 102 contacts the sensing projection 71*e* of the mount sensor 71 inclining in one end side direction. The sensing projection 71*e* senses the insertion of the connected staple assembly cassette 100 with the inclination surface of the front end 71*f*. The mount sensor 71 is elastically deformed and the sensing projection 71*e* opens the passage between the first side wall section 44 and the first inside wall section 52. The second wall plate 103 of the connected staple assembly cassette 100 is inserted between the second side wall section 45 and the second inside wall section 53 of the mount case body 41.

When the advance movement is detected by the inclination surface of the front end 71*f* of the mount sensor 71, and the mount sensor 71 is elastically deformed, the first stop arm 71*g* releases the engagement with the pusher piece 73. The second stop arm 71*h* releases the engagement with the release lever rotating plate 72.

The connected staple assembly cassette 100 further advances deeply. The reverse movement stop feeder 110 moves forward in the pusher piece advance passage 54 in the other end direction. The collision plate 112*b* also advances. When the collision plate 112*b* passes near the release lever rotating plate 72, the rear end sensing arm 72*c* is tilted and rotated by the collision plate 112*b*, and the release lever rotating plate 72 is rotated. When the release lever rotating plate 72 is rotated, the door open arm 74*g* of the horizontal lock door 74*a* serves to open the horizontal lock door 74*a*. Then, the horizontal lock door 74*a* releases the engagement between the lock projection 74*d* and the pusher piece 73. The pusher piece 73 had already been released from the engagement with the first stop arm 71*g*, so that the traction string 73*d* is pulled by the pusher piece traction spring 75, and thereby, slid into the connected staple assembly cassette 100. In thus manner, the pusher piece 73 follows up the collision plate 112*b*, and elastically contacts under pressure against the connected staple assembly 101 from the one end side through the collision plate 112*b*.

When the other end side of the connected staple assembly cassette 100 reaches the inside wall fitting cover 55, the connected staple assembly cassette 100 does not advance further more deeply.

When the operation handle 60 is depressed against the elastic force of the push-down coil spring 62, the blade holder 82 lowers. The staple mount magazine 40 is moved downward by the gravity and friction force with the blade holder 82 and rotated around the mount portion pivot shaft member 49.

When the other end side of the staple mount magazine reaches the horizontal base 31 or the upper surface of the papers stacked, the staple mount magazine stops to rotate.

The lower end of the staple striking blade plate 83 attached to the blade holder 82 is continuously lowered, then reaches the cassette top plate 104 of the connected staple assembly cassette 100, then the staple striking blade plate 83 passes through the advance/retire slit 109. At this time, the lower end contacts one staple 121 on the most other end side of the connected staple assembly 101 and then pushes it downward as it is. There is a case that the staple mount magazine 40 has not still sufficiently lowered, and in such case, when the lower end of the staple striking blade plate 83 pushes downward the staple 121 positioned at the most other end side of the connected staple assembly 101, the staple mount magazine 40 is entirely pulled and lowered by the bonding force or friction force to the adjacent staple 122.

When the operation handle 60 is further depressed, the staples after the second staple from the other end side are suppressed by the upper end surfaces of the first inside wall section 52 and the second inside wall section 53, and only one staple 121 positioned at the most other end side is separated and lowered in the staple lowering slit 94 between the inside wall fitting cover 55 and the vertical portion 92*b* of the plate spring wall sensor 92.

When the staple striking blade plate 83 lowers in the staple lowering slit 94, the thickened portions 83*b* of both side wall sections of the staple striking blade plate 83 advance into the staple lowering slit 94. The thickened portion 83*b* pushes back the subsequent staple 122 after the first one toward the one end side. The force for pushing back the staple 122 is elastically absorbed by the connection member 113 of the reverse movement stop feeder 110. Even if the proceeding piece 111 is slightly retired, the following piece 112 is not retied through the engagement of the pawl projection 112*d* with the engagement irregular portion 106.

When the upper horizontal portion 121*a* of the most other end side staple 121 invades into the staple lowering slit 94, the vertical portion 92*b* of the plate spring wall sensor 92 is pushed toward the one end side, and the usually closed staple lowering slit 94 is opened. When the vertical portion 92*b* of the plate spring wall sensor 92 is pushed toward the one end side, the lower end portion 96*b* of the contacting push-up member 96 is pushed against the step-up surface 97*c* of the inclination surface projection 97. The push-up member 96 moves upward along the inclined step-up surface 97*c*. In association with this motion, the vertically movable member 95 moves upward. The vertically movable member 95 is moved along the guide slit of the first inside wall section 52 and the guide slit of the second inside wall section 53. According to this motion, the vertical movement projection 95a also moves upward. The vertical movement projection 95*a* projects in the advance passage of the staple 122 after the second one to thereby stop the advancing of the staple after the second staple 122.

As far as the most other end side staple 121 is not come off from the staple lowering slit 94, i.e., the most other end side staple 121 remains therein, the plate spring wall sensor 92 is not restored. This situation does not change even if the staple striking blade plate 83 is retired from the staple lowering slit 94, and the subsequent staple 122 after the first one never advance. Two staples do not intrude at once into the staple lowering slit 94, thus preventing from getting into a tangle of the staples.

The staple 121 separated from the front end of the connected staple assembly 101 comes off after passing through the staple lowering slit port 48 and reaches the anvil 35 formed to the horizontal base 32, and when the staple 121 is further pushed downward by the staple striking blade plate 83, it bends in the predetermined shape along the staple groove 35*a*.

When the staple has been come off from the staple lowering slit 94, the vertical portion of the plate spring wall sensor 92 returns to the original position. The vertical coil spring 98 depresses elastically downward the vertically movable member 95. Then, the push-up member 96 is also moved downward, and the lower end 96*b* of the push-up member 96 lowers on the inclining surface of the inclination surface projection 97 and contacts the one end side plate surface of the vertical portion 92*b* of the plate spring wall sensor 92.

The pusher piece 73 pushes under pressure the one end side of the connected staple assembly 101 in the connected staple assembly cassette 100. The subsequent staple 122 after the first one advances by a distance corresponding to the thickness of one staple. The staple 122 has a U-shaped structure having the horizontal portion and both leg portions extending vertically from the horizontal portion. The leg portions of the staple 122 pass a space between the vertical portion 92*b* of the plate spring wall sensor 92 and both the inside wall sections 52, 53. With decrease in the number of the staples, the pusher piece 73 and the reverse movement stop feeder 110 are moved forward each of the respective times. The connected staple assembly 101 is pushed toward the other end side and not retired.

The blade holder 82 of the operation handle 60 is provided, at its upper end, with horizontal shafts 82*e*, 82*e*, which are supported by circular slot 60*a* formed inside the operation handle 60.

When the operation handle 60 is depressed, the shafts 82*e*, 82*e* of the blade holder 82 are slid along the slot 60*a*, and according to such motion, the blade holder 82 is lowered.

When the operation handle 60 is released from being depressed, the operation handle 60 is moved upward by the elastic repulsion force of the push-down twist coil spring 62. At this time, the blade holder 82, the staple striking blade plate 83, the blade guide pad 84, and the staple mount magazine 40 are raised integrally upward, and finally, the staple mount magazine 40 reaches the upper end surface N of the central portion of the horizontal base 31 and then stops there.

The horizontal force directing to the staple striking blade plate 83 due to the tension force of the pusher piece traction spring 75 and the elastic repulsion force of the plate spring sensor 92 are applied to the staple 122 contacting the staple striking blade plate 83, and a friction force is applied between the staple striking blade plate 83 and the staple 122. However, after the staple mount magazine 40 has reached the central upper surface N of the horizontal base 31, the operation handle 60 is further moved upward by the elastic repulsion force of the push-down twist coil spring 62 against its friction force. According to this upward movement of the operation handle 60, the blade holder 82 and the staple striking blade plate 83 moves upward, and the blade holder guide projection 82*c* reaches the upper dead center of the blade plate vertical slit 86*a*. Then, the upward movement of the operation handle stops.

When the connected staple assembly cassette 100 is drawn off from the cassette insertion port 50 of the mount case body 41, the pusher piece 73 returns to one end of the mount case body 41. The pusher piece is then moved downward through the mount port of the feed mechanism 70 and returned to the original position under the guidance of the guide projection 74*e* of the horizontal lock door 74*a*. When the connected staple assembly cassette 100 is removed, the mount sensor 71 returns to the original position, and the first stop arm 71*g* and the second stop arm 71*h* also returns to the original positions.

The stapler of the present invention involves no such operation, as in a stapler of a conventional art, as depressing the operation handle against the repulsion force of the magazine support spring 7 and against, on the way of the operation, the repulsion forces of two springs of magazine support spring 7 and handle support spring 8. That is, the spring that urges against the depressing operation is only one spring of the push-down twist coil spring 62 mounted to the handle pivot shaft portion 61. According to this structure, the staple can be completely struck with a small striking force.

When the staples are used up, the cassette case body 105 and the reverse movement stop feeder 110 become waste. In comparison with the conventional connected staple assembly cassette 20 provided with the feed spring 13, there is no specific combination of different kinds of members, so that waste separation work can be eliminated, providing an environmental merit and enabling the recycled use.

It is not always necessary to arrange the handle plates 33 and 34 having large height. The handle pivot shaft member 61 may be positioned at a low position.

The engaging irregular (concave-convex) portion 106 may be provided for the first wall plate 102 or second wall plate 103 instead of the cassette top plate 104. Furthermore, it may be formed as rectangular through holes formed at equal interval. In the case of forming the wall plate, the pawl projection 112*d* is formed to the following wall plate 112*a* of the following piece 112.

INDUSTRIAL APPLICABILITY

The present invention has an applicability on an industry relating to the manufacture of a stapler stapling a plurality of sheets of papers with a staple bent in approximately U-shape and a connected staple assembly cassette used for the staple striking operation.

The invention claimed is:

1. A stapler including a horizontal base, an operation handle, a staple striking blade plate, and a staple mount magazine with which is mounted a connected staple assembly cassette having a case body and a connected staple assembly composed of a number of staples disposed in the case body, said horizontal base, said operation handle and said staple mount magazine being coupled by means of pivot shaft member, wherein said staple striking blade plate has an upper portion connected to the operation handle and is disposed between the operation handle and the horizontal base, the staple striking blade plate being vertically movable in association with an operation of the operation handle, and the staple striking blade plate has a vertical width such that when the operation handle is pushed down in a direction of the horizontal base, a lower end thereof reaches a surface of the horizontal base, said staple mount magazine has a mount case, a feed mechanism and a staple lowering slit, said mount case serving to vertically hold the connected staple assembly of a number of staples each having a substantial U-shape having a right angled corner portion, having a structure in which both lower ends of the bent staple is directed to the horizontal base, and having one end side and another end side so as to be mounted in a range from a front end to a rear end of the stapler, said one end side is mounted to the rear end side of the connected staple assembly, and said the other end side is mounted to the front end portion of the connected staple assembly and provided with the staple lowering slit as a blade plate passage, said staple lowering slit is formed with an opening so as to guide, in the lowering direction, the staple which is separated from the front end of the connected staple assembly and lowered in the slit, said feed mechanism includes a mount sensor, a pusher piece, a pusher piece engaging member, a pusher piece traction spring, and a release lever rotating plate, said mount sensor having a structure being displaced and deformed by sensing presence or absence of the connected staple assembly, said pusher piece engaging member engages the pusher piece and releases the engaged pusher piece under the condition of the displacement and deformation of the mount sensor, said pusher traction spring elastically pulls the pusher piece in the other end side in the staple mount magazine, said release lever rotating plate is mounted directly below the mount sensor and serves to detect, as a rear end sensing sensor, the passing of the rear end of the connected staple assembly accommodated in the connected staple assembly cassette, and said pusher piece moves from the one end side toward the other end side in the staple mount magazine as an advance passage, the pusher piece is subjected to elastic traction force in the direction towards the other end side by the pusher piece traction spring and advances in the advance passage when the engaged pusher piece is released, and the rear end of the connected staple assembly is formed to be elastically pressed in the direction towards the other end side of the mount case, wherein said pusher piece engaging member comprises:

a horizontal lock door including a release wall, said release wall releasing the pusher piece when it is engaged and locked, a first horizontal rotation shaft and a second horizontal rotation shaft, facing each other, and positioned in one line to engage and lock the pusher piece, and a guide projection positioned on one end of said horizontal lock door and a lock projection positioned on an other end of said horizontal lock door, to guide said pusher piece to its stopping position after the stapling operation completes.

2. The stapler according to claim 1, wherein said feed mechanism is provided with a rear end sensing sensor sensing passing of the rear end of the connected staple assembly at the rear end of the mount magazine at a time of mounting the staple assembly cassette and being displaced and deformed by sensing the passing, and said pusher piece engaging member is provided with releasing means for releasing the engagement with the pusher piece under the condition of the displacement and deformation of the rear end sensing sensor.

3. The stapler according to claim 2, said rear end sensing sensor commonly serves as the mount sensor.

4. The stapler according to claim 1, wherein said release lever rotating plate comprises:

a square portion located in a center of the release lever rotating late, secured to a first extension of one end side of a first side wall section of the feed mechanism;

a rear end sensing arm extending vertically upward from an upper end portion of the square-shaped portion;

wherein a front end of the rear end sensing arm projects into the advance passage of the pusher piece, and wherein the rear end sensing arm is engaged with a second stop arm to allow the mounting sensor to be disengagable in the rotating direction; and a release arm including a traction coil spring, the traction coil spring drawing the release arm in its longitudinal direction.

* * * * *

UNITED STATES PATENT AND TRADEMARK OFFICE

CERTIFICATE OF CORRECTION

PATENT NO. : 7,438,206 B2
APPLICATION NO. : 10/564979
DATED : October 21, 2008
INVENTOR(S) : Michihito Kumayama It is certified that error appears in the above-identified patent and that said Letters Patent is hereby corrected as shown below:

Column 26, Line 30, change “late,” to --plate,--.

Signed and Sealed this

Twentieth Day of January, 2009

JON W. DUDAS
*Director of the United States Patent and Trademark Office*